US009694604B2

(12) United States Patent
Watanabe et al.

(10) Patent No.: US 9,694,604 B2
(45) **Date of Patent: *Jul. 4, 2017**

(54) INKJET RECORDING APPARATUS

(71) Applicant: KYOCERA Document Solutions Inc., Osaka (JP)

(72) Inventors: Takeshi Watanabe, Osaka (JP); Shinji Yoshinaga, Osaka (JP); Hidenori Takenaka, Osaka (JP); Jumpei Hobo, Osaka (JP); Tomohisa Soda, Osaka (JP); Hiroatsu Tamai, Osaka (JP); Satoshi Tsunemi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/994,836

(22) Filed: Jan. 13, 2016

(65) Prior Publication Data

US 2016/0200121 A1 Jul. 14, 2016

(30) Foreign Application Priority Data

Jan. 14, 2015 (JP) ..... 2015-005244
Jan. 14, 2015 (JP) ..... 2015-005248

(51) Int. Cl.
*B41J 29/38* (2006.01)
*B41J 11/00* (2006.01)
*B41J 29/17* (2006.01)

(52) U.S. Cl.
CPC ..... *B41J 11/007* (2013.01); *B41J 11/0085* (2013.01); *B41J 29/17* (2013.01)

(58) Field of Classification Search
CPC ..... B41J 11/0015; B41J 11/007; B41J 29/17; B41J 11/0085; B41J 2/165
USPC ..... 347/16, 22, 104
See application file for complete search history.

(56) References Cited

U.S. PATENT DOCUMENTS 9,427,979 B2 * 8/2016 Takenaka ..... B41J 11/0085
9,505,249 B2 * 11/2016 Tamai ..... B41J 29/17
2009/0244242 A1 * 10/2009 Sawada ..... B41J 11/0085 347/104

(Continued)

FOREIGN PATENT DOCUMENTS

JP 2008-213255 A 9/2008
JP 2011-183746 A 9/2011

*Primary Examiner* — Jannelle M Lebron
(74) *Attorney, Agent, or Firm* — Studebaker & Brackett PC

(57) ABSTRACT

An inkjet recording apparatus includes a control section, a conveyance section, a recording head, a negative pressure applying section, a gap forming section, and a first voltage applying section. The conveyance section conveys a recording medium placed on a conveying surface. The negative pressure applying section applies negative pressure to holes in the conveying surface to suck the recording medium onto the conveying surface. The gap forming section forms a narrow gap, with the conveying surface, further upstream in a conveyance direction of the recording medium than the recording head. The gap forming section is composed of at least a part of a conductive portion. The first voltage applying section applies a voltage to the conductive portion. The control section controls the first voltage applying section to apply the voltage to the conductive portion while the inkjet recording apparatus performs a specific process.

19 Claims, 15 Drawing Sheets

(56) References Cited

U.S. PATENT DOCUMENTS

| | | | | |
|---|---|---|---|---|
| 2011/0181639 | A1* | 7/2011 | Leoni | B41J 11/005 347/9 |
| 2016/0129712 | A1* | 5/2016 | Yoshinaga | B41J 29/17 347/101 |

* cited by examiner

INKJET RECORDING APPARATUS

INCORPORATION BY REFERENCE

The present application claims priority under 35 U.S.C. §119 to Japanese Patent Application No. 2015-005244, filed on Jan. 14, 2015 and Japanese Patent Application No. 2015-005248, filed on Jan. 14, 2015. The contents of these applications are incorporated herein by reference in their entirety.

BACKGROUND

The present disclosure relates to an inkjet recording apparatus.

An inkjet recording apparatus that ejects ink onto a recording medium may adopt a known paper dust removal technique in order to address a problem of nozzle clogging in a recording head.

In one known example, an inkjet recording apparatus includes a paper dust collector upstream in a conveyance direction of a recording medium relative to a recording head. The paper dust collector includes a vertical wall and a downstream wall. The vertical wall stands vertically upward. The downstream wall extends downstream in the conveyance direction of the recording medium from a top end of the vertical wall.

The amount of paper dust that attaches to the recording head is reduced as a consequence of the paper dust collector collecting paper dust that arises during conveyance of the recording medium, before the paper dust reaches the recording head.

SUMMARY

An inkjet recording apparatus according to one aspect of the present disclosure includes a control section, a conveyance section, a recording head, a negative pressure applying section, a gap forming section, and a first voltage applying section. The conveyance section conveys a recording medium placed on a conveying surface. The recording head ejects ink onto the recording medium conveyed by the conveyance section to form an image on the recording medium. The negative pressure applying section applies negative pressure via a plurality of holes in the conveying surface to suck the recording medium conveyed by the conveyance section onto the conveying surface. The gap forming section forms a narrow gap in conjunction with the conveying surface at a location further upstream in a conveyance direction of the recording medium than the recording head. The gap forming section includes a conductive portion that is electrically conductive and that composes at least a part of the gap forming section. The first voltage applying section applies a voltage to the conductive portion. A distance across the narrow gap in a direction perpendicular to the conveying surface is set such that air flowing into the narrow gap from surrounding space has a higher flow velocity in the narrow gap than before flowing into the narrow gap. The control section controls the first voltage applying section to apply the voltage to the conductive portion while the inkjet recording apparatus performs a specific process.

DETAILED DESCRIPTION

Figure 1:
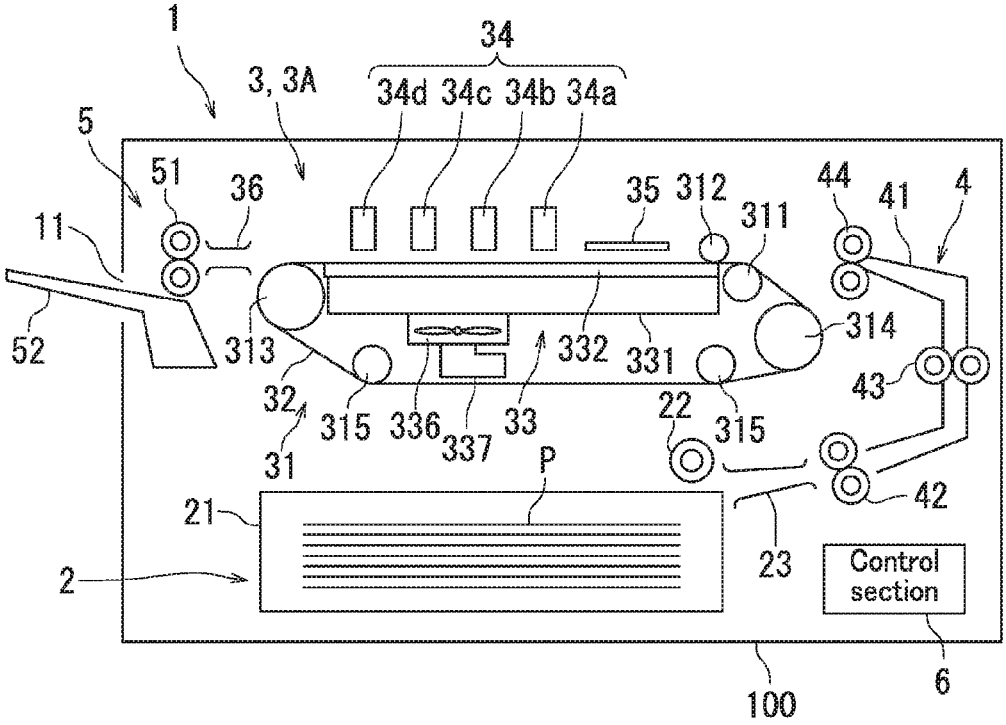
FIG. 1 illustrates configuration of an inkjet recording apparatus according to an embodiment.

The following explains embodiments of the present disclosure with reference to the drawings. Elements that are the same or equivalent are assigned the same reference signs in the drawings and are not repeatedly explained.

First, an inkjet recording apparatus 1 according to an embodiment of the present disclosure is explained with reference to FIG. 1. FIG. 1 illustrates configuration of the inkjet recording apparatus 1 according to the embodiment of the present disclosure. The inkjet recording apparatus 1 includes an apparatus housing 100, a sheet feed section 2 located in a lower part of the apparatus housing 100, an image forming section 3/3A located above the sheet feed section 2, a sheet conveyance section 4 located to one side (right side in FIG. 1) of the image forming section 3/3A, a sheet ejecting section 5 located to the other side (left side in FIG. 1) of the image forming section 3/3A, and a control section 6.

The sheet feed section 2 includes a sheet feed cassette 21, a sheet feed roller 22, and guide plates 23. The sheet feed cassette 21 is loaded with recording sheets P and is freely detachable from the apparatus housing 100. The sheet feed roller 22 is located above one end (right end in FIG. 1) of the sheet feed cassette 21. The guide plates 23 are located between the sheet feed roller 22 and the sheet conveyance section 4.

Recording sheets P are stored in the sheet feed cassette 21. Herein, a "recording sheet" is referred to simply as a "sheet" for convenience. Also note that a recording sheet P is equivalent to an example of a "recording medium." The sheet feed roller (pickup roller) 22 picks up an uppermost sheet P in the sheet feed cassette 21, one sheet at a time, and feeds the sheet P in a conveyance direction of the sheet P (sheet conveyance direction). The guide plates 23 guide the sheet P to the sheet conveyance section 4 once the sheet P is picked up by the sheet feed roller 22.

The sheet conveyance section 4 includes an substantially C-shaped sheet conveyance path 41, a pair of first conveyance rollers 42 located at an entry end of the sheet conveyance path 41, a pair of second conveyance rollers 43 located partway along the sheet conveyance path 41, and a pair of registration rollers 44 located at an exit end of the sheet conveyance path 41.

The pair of first conveyance rollers 42 is a pair of rollers (pair of feeding rollers) that feeds the sheet P in the conveyance direction of the sheet P. The pair of first conveyance rollers 42 sandwiches the sheet P fed from the sheet feed section 2 and feeds the sheet P into the sheet conveyance path 41. The pair of second conveyance rollers 43 is a pair of feeding rollers. The pair of second conveyance rollers 43 sandwiches the sheet P fed from the pair of first conveyance rollers 42 and feeds the sheet P toward the pair of registration rollers 44.

The pair of registration rollers 44 performs skew correction of the sheet P conveyed from the pair of second conveyance rollers 43. In order to synchronize timing of image formation on the sheet P and timing of conveyance of the sheet P, the pair of registration rollers 44 temporarily halts the sheet P and then feeds the sheet P to the image forming section 3/3A in accordance with timing of image formation on the sheet P.

The image forming section 3/3A includes a conveyor belt 32 and recording heads 34. The image forming section 3/3A conveys the sheet P fed from the pair of registration rollers 44 in a specific direction (leftward in FIG. 1) through the conveyor belt 32 and forms an image on the sheet P conveyed by the conveyor belt 32 through the recording heads 34. Detailed explanation of configuration of the image forming section 3/3A is provided further below with reference to FIGS. 2 and 13. The image forming section 3/3A also includes conveyance guides 36 located downstream in the conveyance direction of the sheet P (leftward in FIG. 1) relative to the recording heads 34.

When the sheet P is ejected from the conveyor belt 32, the conveyance guides 36 guide the sheet P to the sheet ejecting section 5. The sheet ejecting section 5 includes a pair of ejection rollers 51 and an exit tray 52. The exit tray 52 is fixed to the apparatus housing 100 so as to protrude externally from an exit port 11 formed in the apparatus housing 100.

Once the sheet P has passed along the conveyance guides 36, the pair of ejection rollers 51 feeds the sheet P toward the exit port 11. The exit tray 52 guides the sheet P fed by the pair of ejection rollers 51. The sheet P fed by the pair of ejection rollers 51 is ejected externally from the apparatus housing 100 via the exit port 11, which is located in one side surface (left side surface in FIG. 1) of the apparatus housing 100. The exit tray 52 stores sheets P ejected from the exit port 11 as a stack.

The control section 6 controls operation of the inkjet recording apparatus 1. The control section 6 includes a central processing unit (CPU) and a memory. The memory stores a computer program, such as firmware, that is executed by the CPU. The CPU implements functions of the control section 6 by executing the computer program stored by the memory.

First Embodiment

Figure 2:
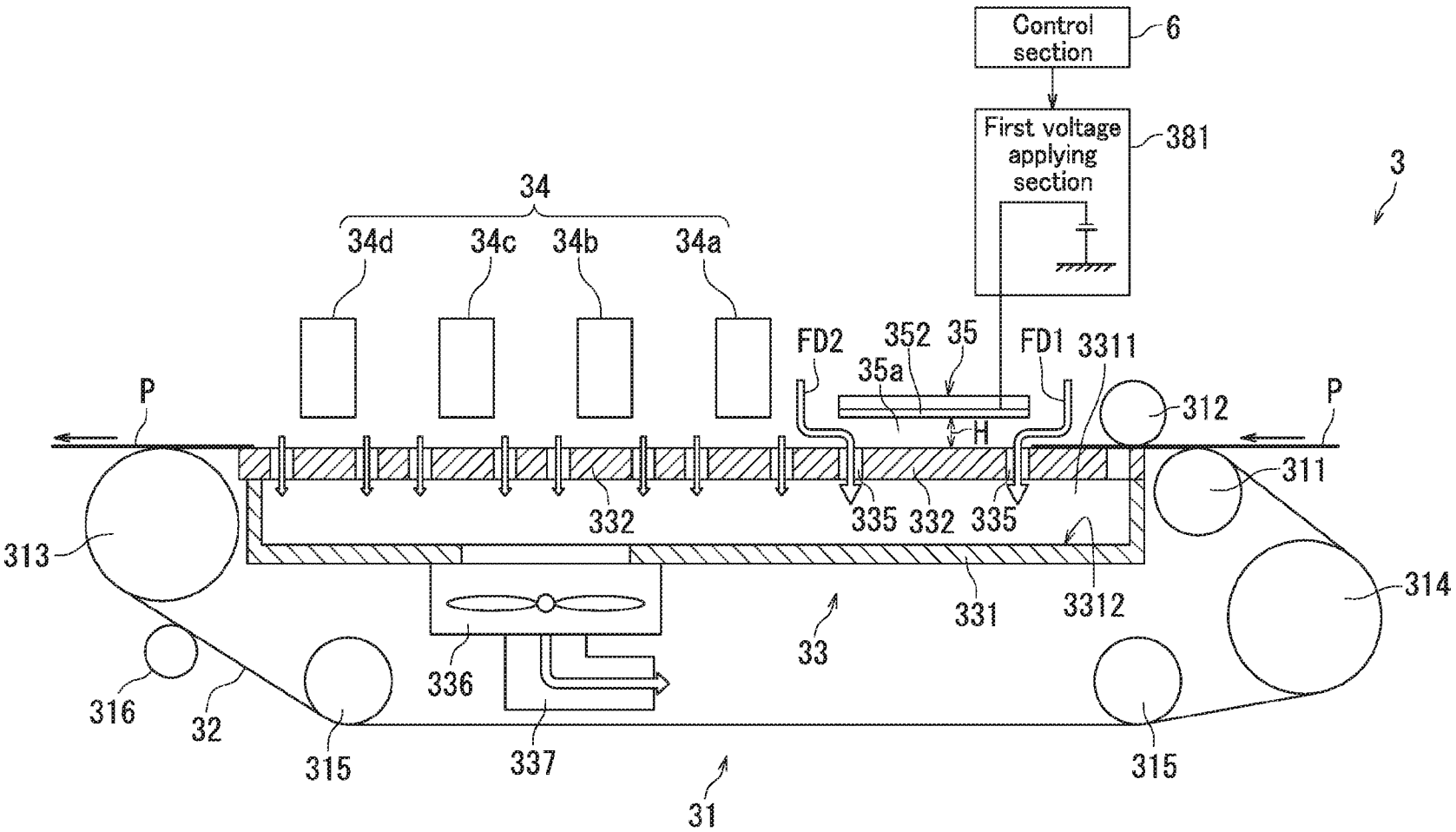
FIG. 2 illustrates a first example of configuration of an image forming section according to a first embodiment.

The following explains an image forming section 3 according to a first embodiment with reference to FIG. 2. FIG. 2 illustrates a first example of configuration of the image forming section 3 according to the first embodiment. Configuration of the image forming section 3 according to the first embodiment is not limited to the example of configuration illustrated in FIG. 2. Other examples of configuration of the image forming section 3 are explained further below with reference to FIGS. 8-12.

As illustrated in FIG. 2, the image forming section 3 includes a conveyance section 31, a negative pressure applying section 33, recording heads 34, a plate member 35, and a first voltage applying section 381. The recording heads 34 are four different types of recording heads 34*a*, 34*b*, 34*c*, and 34*d* that each include nozzles (not illustrated). Ink is ejected from the nozzles in order to form an image, such as characters or a figure, on a sheet P. The recording heads 34*a*, 34*b*, 34*c*, and 34*d* have substantially the same configuration and may therefore be referred to generally as recording heads 34.

The conveyance section 31 conveys the sheet P in a specific direction (leftward in FIG. 2). The conveyance section 31 includes a belt-speed detecting roller 311, a placement roller 312, a drive roller 313, a tension roller 314, a pair of guide rollers 315, a liquid suction roller 316, and a conveyor belt 32.

The conveyance section 31 is located opposite to the four types of recording heads 34 (34*a*, 34*b*, 34*c*, and 34*d*) inside of the apparatus housing 100. The conveyor belt 32 is stretched around the belt-speed detecting roller 311, the drive roller 313, the tension roller 314, and the pair of guide rollers 315. The conveyor belt 32 is driven in the conveyance direction of the sheet P (counterclockwise in FIG. 2) to convey the sheet P. The conveyor belt 32 is equivalent to an example of an "endless belt."

The tension roller 314 applies tension to the conveyor belt 32 so that the conveyor belt 32 does not sag.

The belt-speed detecting roller 311 is located upstream in the conveyance direction of the sheet P (rightward in FIG. 2) relative to the negative pressure applying section 33 and rotates through friction with the conveyor belt 32. The belt-speed detecting roller 311 includes a pulse plate (not illustrated) that rotates integrally with the belt-speed detecting roller 311. The circulation speed of the conveyor belt 32 is detected by measuring the rotational speed of the pulse plate.

The drive roller 313 is located downstream in the conveyance direction of the sheet P (leftward in FIG. 1) relative to the negative pressure applying section 33. The drive roller 313 preferably functions in conjunction with the belt-speed detecting roller 311 to maintain flatness of the conveyor belt 32 at positions opposite to the recording heads 34.

The drive roller 313 is rotationally driven by a motor (not illustrated) such that the drive roller 313 causes circulation of the conveyor belt 32 in a direction corresponding to counterclockwise in FIG. 2.

The pair of guide rollers 315 is located below the negative pressure applying section 33 and creates a space below the negative pressure applying section 33. Such positioning of the pair of guide rollers 315 can prevent contact between the conveyor belt 32 and the negative pressure applying section 33 below the negative pressure applying section 33.

The four types of recording heads 34 (34*a*, 34*b*, 34*c*, and 34*d*) are arranged from upstream to downstream in the conveyance direction of the sheet P. The recording heads 34*a*, 34*b*, 34*c*, and 34*d* each include nozzles (not illustrated) that are arranged in rows in a width direction of the conveyor belt 32 (direction perpendicular to the plane of FIG. 2). Each of the recording heads 34*a*, 34*b*, 34*c*, and 34*d* is referred to as a line head. In other words, the inkjet recording apparatus 1 is a line head inkjet recording apparatus.

The negative pressure applying section 33 causes the sheet P to be sucked onto the conveyor belt 32 by applying negative pressure to the sheet P through suction holes 321 (refer to FIG. 4) in the conveyor belt 32. The negative pressure applying section 33 is located at a rear surface side (below in FIG. 2) of the conveyor belt 32 such as to be opposite to the four types of recording heads 34 with the conveyor belt 32 in-between. The negative pressure applying section 33 includes an air flow chamber 331, a guide member 332 that covers an opening at the top of the air flow chamber 331, a negative pressure creating section 336, and a duct 337.

The placement roller 312 is a driven roller. The placement roller 312 is located further upstream in the conveyance direction of the sheet P than the plate member 35. The placement roller 312 presses the sheet P onto an upper surface of the conveyor belt 32 (conveying surface on which the sheet P is placed, referred to below simply as a "conveying surface") and feeds the sheet P downstream in the conveyance direction of the sheet P. At least an outer circumferential surface of the placement roller 312 is made from a conductive material such as a conductive fluorine rubber. The placement roller 312 is located opposite to the guide member 332 with the conveyor belt 32 in-between. The placement roller 312 guides a sheet P that has been fed from the pair of registration rollers 44 onto the conveyor belt 32 so that the sheet P is sucked onto the conveyor belt 32.

The liquid suction roller 316 is used to clean the conveyor belt 32 in a process for internal cleaning of the inkjet recording apparatus 1 (referred to below as a "cleaning process"). An outer circumferential surface of the liquid suction roller 316 is made from a material that sucks up ink, such as sponge. During the cleaning process, the liquid suction roller 316 is moved to a position at which the outer circumferential surface of the liquid suction roller 316 is in contact with the conveyor belt 32. The liquid suction roller 316 rotates in contact with the conveyor belt 32 while sucking up ink attached to the conveyor belt 32 and thereby removing the ink from the conveyor belt 32.

The guide member 332 supports the sheet P through the conveyor belt 32. The guide member 332 is equivalent to an example of a "conveyance plate." The guide member 332 has through holes 335. The guide member 332 is for example made from a metallic material. Specifically, the guide member 332 can be made from die-cast aluminum or pressed metal plate. The guide member 332 is grounded. In the first embodiment, the through holes 335 each extend through the guide member 332 from a bottom surface of a corresponding groove 334 formed in an upper surface of the guide member 332; however, it should be noted that the grooves 334 (refer to FIGS. 3, 4, etc.) are not illustrated in FIG. 2.

Although the guide member 332 in the first embodiment is described as part of the negative pressure applying section 33 for convenience, the guide member 332 may alternatively be described as part of the conveyance section 31 because the guide member 332 supports the conveyor belt 32 as described above.

The air flow chamber 331 forms a space 3311 (referred to below as a "negative pressure creation space") in which negative pressure for sucking the sheet P toward the conveyor belt 32 is created. In the first embodiment, the air flow chamber 331 is a box-shaped member that is a tube having an open top end and a closed bottom end. An upper surface of a side wall of the air flow chamber 331 is fixed to the guide member 332. The opening at the top of the air flow chamber 331 is covered by the guide member 332. In other words, the guide member 332 is an upper wall of the air flow chamber 331 in the first embodiment.

The negative pressure creating section 336 is a device that creates negative pressure inside of the air flow chamber 331, such as a fan or a vacuum pump. The negative pressure creating section 336 is located below the air flow chamber 331; more specifically, the negative pressure creating section 336 is located at a bottom surface 3312 of the air flow chamber 331. The negative pressure creating section 336 creates negative pressure inside of the air flow chamber 331 by discharging air out of the air flow chamber 331 via the duct 337. The negative pressure created inside of the air flow chamber 331 sucks on the sheet P through the suction holes 321 (refer to FIG. 4) in the conveyor belt 32 and the through holes 335 in the guide member 332 such that the sheet P is sucked toward the conveyor belt 32 and is held on the conveyor belt 32 by suction. Through the above, the conveyance section 31 can convey the sheet P while holding the sheet P on the conveyor belt 32 by suction.

The plate member 35 is located further upstream in the conveyance direction of the sheet P (rightward in FIG. 2) than the recording heads 34. In other words, the plate member 35 is located between the recording head 34*a* and the placement roller 312. The plate member 35 is equivalent to an example of a "gap forming section." Note that a gap between the plate member 35 and the conveying surface (guide member 332) is described further below as a narrow gap 35*a*.

The following explains operation of the inkjet recording apparatus 1 with reference to FIG. 1. A sheet P is picked up from the sheet feed cassette 21 by the sheet feed roller 22. The picked-up sheet P is guided to the pair of first conveyance rollers 42 by the guide plates 23.

Thereafter, the sheet P is fed into the sheet conveyance path 41 by the pair of first conveyance rollers 42 and is conveyed in the conveyance direction of the sheet P by the pair of second conveyance rollers 43. The sheet P is halted upon coming into contact with the pair of registration rollers 44 which performs skew correction on the sheet P. Next, the sheet P is fed to the image forming section 3 by the pair of registration rollers 44 in accordance with timing of image formation.

The sheet P is guided onto the conveyor belt 32 by the placement roller 312 so as to be sucked onto the conveyor belt 32. The sheet P is preferably guided onto the conveyor belt 32 such that the center of the sheet P in a width direction thereof coincides with the center of the conveyor belt 32 in the width direction thereof. The sheet P covers some of the numerous suction holes 321 (refer to FIG. 4) in the conveyor belt 32. The negative pressure applying section 33 sucks air through the guide member 332 and the conveyor belt 32 and creates negative pressure in the air flow chamber 331. Through the above, the negative pressure acts on the sheet P to suck the sheet P onto the conveyor belt 32. The sheet P is conveyed in the conveyance direction of the sheet P as the conveyor belt 32 moves.

The sheet P is conveyed by the conveyor belt 32 such that all portions of the sheet P sequentially become positioned opposite to the four types of recording heads 34*a*, 34*b*, 34*c*, and 34*d*. While the sheet P is being conveyed by the conveyor belt 32 as described above, the four types of recording heads 34*a*, 34*b*, 34*c*, and 34*d* each eject ink of a corresponding color onto the conveyed sheet P. Through the above, an image is formed on the sheet P.

The sheet P is conveyed from the conveyor belt 32 to the conveyance guides 36. Once the sheet P has passed along the conveyance guides 36, the sheet P is fed toward the exit port 11 by the pair of ejection rollers 51 and is guided by the exit tray 52 so as to be ejected externally from the apparatus housing 100 via the exit port 11.

Figure 3:
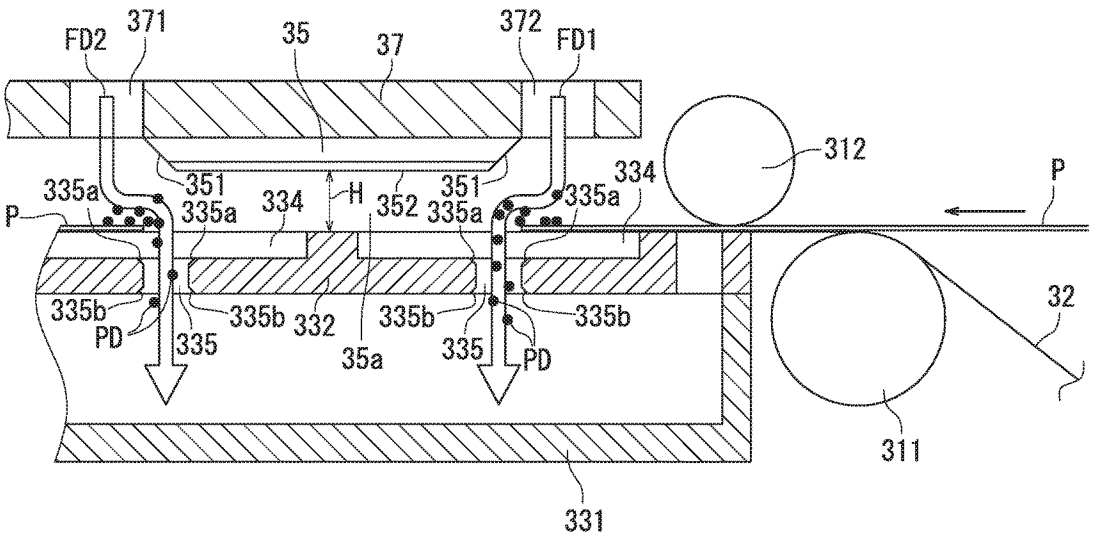
FIG. 3 illustrates configuration around a plate member illustrated in FIG. 2.

The following explains configuration around the plate member 35 with reference to FIG. 3. FIG. 3 illustrates configuration around the plate member 35 illustrated in FIG. 2.

As illustrated in FIG. 3, the plate member 35 is fixed to a head base 37. The head base 37 is a plate member to which the recording heads 34 are fixed. A distance H across the narrow gap 35*a* is set such that air flowing into the narrow gap 35*a* from surrounding space has a higher flow velocity in the narrow gap 35*a* than before flowing into the narrow gap 35*a*. The distance H is a distance across the narrow gap 35*a* in a direction perpendicular to the upper surface (conveying surface) of the conveyor belt 32—that is, a width (distance) of the narrow gap 35*a* in a vertical direction. More specifically, a lower surface of the plate member 35 and the upper surface of the conveyor belt 32 in conjunction form the narrow gap 35*a* of the distance H which is no greater than a preset threshold distance HS (for example, 3 mm). The distance H is, for example, 2 mm in the first embodiment.

The plate member 35 includes a conductive portion 352 that is electrically conductive. The conductive portion 352 composes at least a part of the plate member 35. In the example illustrated in FIGS. 2 and 3, the conductive portion 352 is located at a side of the plate member 35 that faces the conveying surface and is therefore a lower surface of the plate member 35. The conductive portion 352 is made from a conductive material—for example, a metal such as stainless steel.

In the above explanation with reference to FIG. 3, a situation is described in which the thickness of the sheet P is sufficiently thin relative to the distance H. However, the distance H may be adjusted in accordance with the thickness of the sheet P. More specifically, the plate member 35 may for example be raised and lowered in accordance with the thickness of the sheet P such that a distance between the upper surface of the sheet P and the lower surface of the plate member 35 remains substantially constant (for example, 2 mm).

The head base 37 has holes 371 and 372 that are respectively located downstream in the conveyance direction of the sheet P (leftward in FIG. 3) relative to the plate member 35 and upstream in the conveyance direction of the sheet P (rightward in FIG. 3) relative to the plate member 35, and that allow air to flow into the narrow gap 35*a*. Each of the holes 371 and 372 is a long hole that is elongated in the width direction of the sheet P (direction perpendicular to the plane of FIG. 3).

Although the first embodiment is explained for a configuration in which holes in the head base 37 are the holes 371 and 372 that are elongated in the width direction of the sheet P, in an alternative configuration, the holes in the head base 37 may have a different shape. For example, the holes in the head base 37 may be substantially cylindrical and a plurality of the holes may be arranged in the width direction of the sheet P.

Air that flows into the narrow gap 35*a* through the holes 371 and 372 in the head base 37 subsequently flows into the air flow chamber 331 through the suction holes 321 in the conveyor belt 32 and the through holes 335 in the guide member 332. In other words, air flows into the air flow chamber 331 through the suction holes 321 in the conveyor belt 32 and the through holes 335 in the guide member 332 as a result of the air flow chamber 331 being placed in a negative pressure state (for example, with a difference relative to atmospheric pressure of approximately 0.005 atm≈approximately 500 Pa) by the negative pressure creating section 336. In addition, as a consequence of air flowing into the air flow chamber 331 from the narrow gap 35*a*, air flows into the narrow gap 35*a* through the holes 371 and 372 in the head base 37.

As described above, air flows along arrows FD1 and FD2 illustrated in FIG. 3. The flow velocity of the air increases in the narrow gap 35*a* as a result of the distance H being set as no greater than the preset threshold distance HS. The flow velocity in the narrow gap 35*a* is, for example, preferably at least 6.0 m/sec.

As explained above, air flowing along the arrow FD1 flows from upstream to downstream in the conveyance direction of the sheet P (leftward in FIG. 3) in the narrow gap 35*a*. Therefore, paper dust PD attached to a leading edge of the sheet P (left edge in FIG. 3) can be removed and collected inside of the air flow chamber 331 as illustrated in FIG. 3. In addition, air flowing along the arrow FD2 flows from downstream to upstream in the conveyance direction of the sheet P (rightward in FIG. 3) in the narrow gap 35*a*. Therefore, paper dust PD attached to a trailing edge of the sheet P (right edge in FIG. 3) can be removed and collected inside of the air flow chamber 331 as illustrated in FIG. 3. The above enables effective removal of paper dust attached to the sheet P.

Furthermore, fixing of the plate member 35 to the head base 37 as described above simplifies positioning of the plate member 35. In addition, by providing the holes 371 and 372 in the head base 37 that allow air to flow into the narrow gap 35*a*, smooth flow of air into the narrow gap 35*a* can be facilitated.

Although the first embodiment is explained for a configuration in which the plate member 35 is fixed to the head base 37, in an alternative configuration, the plate member 35 may be fixed to the apparatus housing 100 illustrated in FIG. 1. For example, in an alternative configuration, a fixing member that extends from the apparatus housing 100 may fix opposite ends of the plate member 35 in a width direction thereof (direction perpendicular to the plane of FIG. 3). In the above configuration, the flow velocity of air in the narrow gap 35*a* can be further increased because there is no element obstructing flow of air into the narrow gap 35*a* from downstream or upstream in the conveyance direction of the sheet P. Therefore, paper dust can be more effectively removed.

As illustrated in FIG. 3, the plate member 35 has tapers 351 such that the distance H increases with increasing proximity to an end of the plate member 35 in the conveyance direction of the sheet P (left-right direction in FIG. 3). Through the taper 351 on the right-hand side in FIG. 3, the distance H increases with increasing proximity to an upstream end of the plate member 35 in the conveyance direction of the sheet P (left-right direction in FIG. 3). Furthermore, through the taper 351 on the left-hand side in FIG. 3, the distance H increases with increasing proximity to a downstream end of the plate member 35 in the conveyance direction of the sheet P (left-right direction in FIG. 3). In other words, the tapers 351 are respectively provided at the upstream end and the downstream end of the plate member 35 in the conveyance direction of the sheet P such that the plate member 35 has a tapered shape that becomes thinner with increasing proximity to either of the ends of the plate member 35 in the conveyance direction of the sheet P.

As a result of the tapers 351 being provided in the plate member 35 as described above such that the distance H increases with increasing proximity to either end of the plate member 35 in the conveyance direction of the sheet P (left-right direction in FIG. 3), pressure loss of air flowing along the plate member 35 can be reduced. Therefore, paper dust can be removed more effectively as a result of increased air flow velocity in the narrow gap 35*a*.

Figure 4:
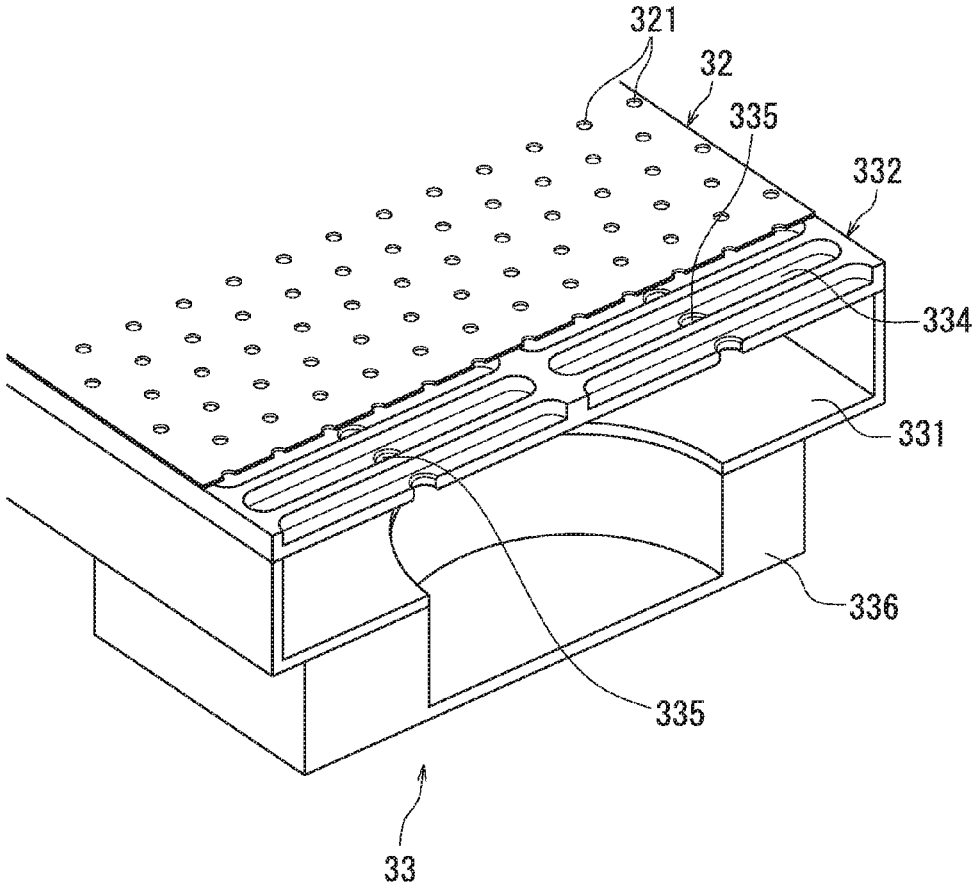
FIG. 4 is a cut-away perspective view illustrating configuration of a conveyor belt, a guide member, and a negative pressure applying section illustrated in FIG. 2.

The following explains configuration of the conveyor belt 32, the guide member 332, and the negative pressure applying section 33 with reference to FIG. 4. FIG. 4 is a cut-away perspective view illustrating configuration of the conveyor belt 32, the guide member 332, and the negative pressure applying section 33 illustrated in FIG. 2.

As illustrated in FIG. 4, the conveyor belt 32, the guide member 332, the air flow chamber 331, and the negative pressure creating section 336 are located in order from top to bottom. The conveyor belt 32 has numerous suction holes 321.

The following explains the suction holes 321 in the conveyor belt 32. As illustrated in FIG. 4, the numerous suction holes 321 are arranged at approximately equal intervals in the conveyor belt 32. The suction holes 321 each have a diameter of, for example, 2 mm and are arranged at intervals of, for example, 8 mm.

Grooves 334 are located in an upper surface of the guide member 332 (surface at a side corresponding to the conveyor belt 32). Each of the grooves 334 has an oval shape that is elongated in the conveyance direction of the sheet P.

Figure 5:
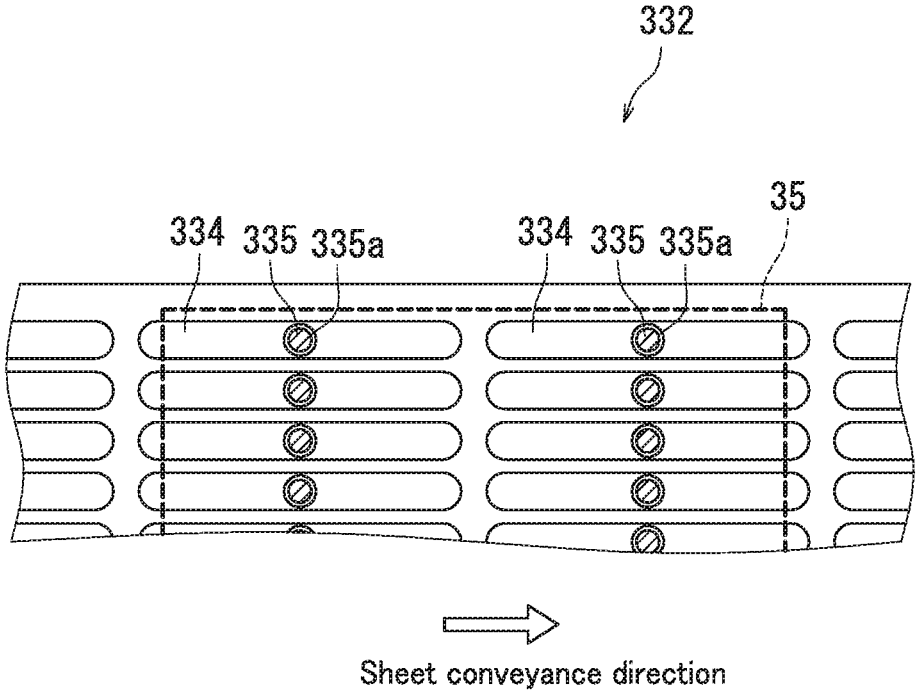
FIG. 5 is a plan view illustrating configuration of the guide member illustrated in FIG. 4.

The following explains the grooves 334 and the through holes 335 in the guide member 332 with reference to FIG. 5. FIG. 5 is a plan view illustrating configuration of the guide member 332 illustrated in FIG. 4. As illustrated in FIG. 5, rows of grooves 334—each groove 334 has an oval shape that is elongated in the conveyance direction of the sheet P (left-right direction in FIG. 5)—are located in the guide member 332 in a width direction of the guide member 332 (up-down direction in FIG. 5). In each of the grooves 334, a through hole 335 that extends through the guide member 332 in a thickness direction thereof is located at an approximately central position in the conveyance direction of the sheet P (left-right direction in FIG. 5). The through holes 335 each have a circular cross-section.

A dashed line in FIG. 5 indicates a projected position of the plate member 35 on the guide member 332. Relative to the projection of the plate member 35 on the guide member 332, one row of through holes 335 is located on an upstream side in the conveyance direction of the sheet P (left side in FIG. 5) and another row of through holes 335 is located on a downstream side in the conveyance direction of the sheet P (right side in FIG. 5). Grooves 334 connected to the through holes 335 at the upstream side in the conveyance direction of the sheet P (left side in FIG. 5) each extend further upstream in the conveyance direction of the sheet P than an upstream edge in the conveyance direction of the sheet P (left edge in FIG. 4) of the projection of the plate member 35. Likewise, grooves 334 connected to the through holes 335 at the downstream side in the conveyance direction of the sheet P (right side in FIG. 5) each extend further downstream in the conveyance direction of the sheet P than a downstream edge in the conveyance direction of the sheet P (right edge in FIG. 5) of the projection of the plate member 35.

Figure 6A:
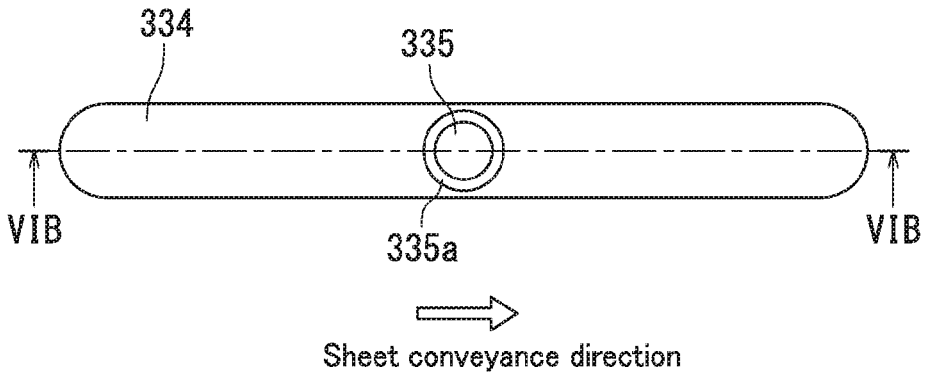
FIG. 6A is a plan view illustrating configuration of the groove and the through hole in the guide member illustrated in FIG. 5.
Figure 6B:
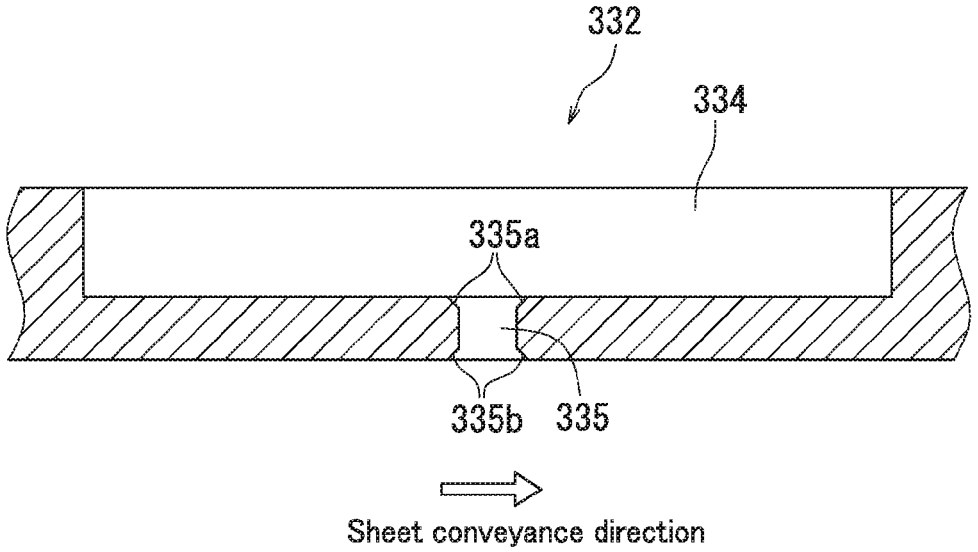
FIG. 6B is a cross-sectional view along a line VIB-VIB of the groove and the through hole illustrated in FIG. 6A.

The following explains the grooves 334 and the through holes 335 in the guide member 332 with reference to FIGS. 6A and 6B. FIG. 6A is a plan view illustrating configuration of the groove 334 and the through hole 335 in the guide member 332 illustrated in FIG. 5, whereas FIG. 6B is a cross-sectional view along a line VIB-VIB of the groove 334 and the through hole 335 illustrated in FIG. 6A.

As illustrated in FIG. 6A, the through hole 335 is located approximately centrally in the groove 334 in the conveyance direction of the sheet P (left-right direction in FIG. 6A) and passes through the guide member 332 in the thickness direction thereof. As illustrated in FIG. 6B, the groove 334 is connected to the through hole 335 and, as a result, negative pressure applied by the air flow chamber 331 through the through hole 335 also acts in a region in which the groove 334 is present. A taper 335*a* and a taper 335*b* are respectively located at an upper end and a lower end of the through hole 335.

As explained above, grooves 334 are present at positions opposite to the plate member 35 and, as a result, negative pressure applied through the through holes 335 by the air flow chamber 331 also acts in regions in which the grooves 334 are present. Therefore, air can flow more easily along the arrows FD1 and FD2 illustrated in FIG. 3 and paper dust can be removed more effectively.

Furthermore, as a result of the tapers 335*a* and 335*b* being present at the upper and lower ends of the through holes 335, pressure loss of air flowing through the through holes 335 can be reduced. Therefore, air can flow more easily along the arrows FD1 and FD2 illustrated in FIG. 3 and paper dust can be removed more effectively.

The following explanation returns to FIG. 4 to explain a positional relationship between the suction holes 321 in the conveyor belt 32 and the grooves 334 in the guide member 332. The conveyor belt 32 has rows of suction holes 321 arranged in the width direction of the conveyor belt 32 (direction perpendicular to the conveyance direction of the sheet P) with each of the rows being composed of numerous suction holes 321 arranged in the conveyance direction of the sheet P. The rows of suction holes 321 are arranged such that the suction holes 321 are in a staggered formation. As illustrated in FIG. 4, the rows of suction holes 321 in the conveyor belt 32 are arranged in correspondence with the rows of grooves 334.

Each of the grooves 334 is located opposite to at least two of the suction holes 321. The suction holes 321 located opposite to each of the grooves 334 change one by one as the conveyor belt 32 moves.

The air flow chamber 331 in which negative pressure is created by the negative pressure creating section 336 is connected to the suction holes 321 in the conveyor belt 32 via the through holes 335 and the grooves 334 in the guide member 332.

As explained above, the sheet P can be sucked onto the conveyor belt 32 during conveyance through application of negative pressure to the suction holes 321 in the conveyor belt 32.

The following explanation once again refers to FIG. 2. The first voltage applying section 381 applies a voltage of a first polarity to the conductive portion 352 of the plate member 35 under the control of the control section 6. The first polarity is the same polarity as a polarity to which at least part (specifically, the nozzles) of the recording heads 34 is charged to; in the first embodiment, the first polarity is negative polarity. The nozzles of the recording heads 34 are for example charged to the first polarity in ejection of ink. The first voltage applying section 381 applies a voltage of, for example, −1.0 kV to the conductive portion 352 of the plate member 35.

Therefore, the inkjet recording apparatus 1 can cause paper dust charged to a second polarity (positive polarity in the first embodiment), opposite to the first polarity, to attach to the conductive portion 352 of the plate member 35 by applying the voltage of the first polarity to the conductive portion 352 of the plate member 35. In other words, the inkjet recording apparatus 1 can effectively collect paper dust charged to the second polarity, which tends to readily attach to the nozzles, further upstream in the conveyance direction of the sheet P than the recording heads 34. Therefore, the inkjet recording apparatus 1 can reduce the amount of paper dust that is carried below the recording heads 34 (in particular, the amount of paper dust charged to the second polarity that tends to readily attach to the nozzles) and can effectively restrict paper dust from attaching to the nozzles.

Application of the voltage of the first polarity to the conductive portion 352 of the plate member 35 has the following effect. As explained with reference to FIG. 3, when the leading edge or the trailing edge of the sheet P passes under the plate member 35, paper dust attached to the leading edge or the trailing edge of the sheet P is collected inside of the air flow chamber 331 through air flowing along the arrow FD1 or the arrow FD2. In contrast, when a central portion of the sheet P passes under the plate member 35, the majority of the grooves 334 present under the plate member 35 are covered by the sheet P. As a result, the suction amount of air (amount of air sucked per unit time) through the through holes 335 present below the plate member 35 decreases and air flow velocity in the narrow gap 35*a* decreases. Therefore, paper dust attached to the central portion of the sheet P tends to be harder to collect in the air flow chamber 331 and harder to remove from the sheet P.

In consideration of the above, the inkjet recording apparatus 1 can remove paper dust attached to the central portion of the sheet P (in particular, paper dust charged to the second polarity that tends to readily attach to the nozzles) by applying the voltage of the first polarity to the conductive portion 352 of the plate member 35 so that the paper dust attaches to the conductive portion 352 of the plate member 35. It should be noted that the inkjet recording apparatus 1 can also remove paper dust attached to the leading edge or the trailing edge of the sheet P by causing the paper dust to attach to the conductive portion 352 of the plate member 35. Therefore, the inkjet recording apparatus 1 can remove paper dust attached to the sheet P more effectively than a configuration in which a voltage of the first polarity is not applied to the conductive portion 352 and in which paper dust is collected only through air suction.

In a situation in which a plurality of conductive portions 352 is provided, the first voltage applying section 381 applies a voltage of the first polarity to some conductive portions 352 and applies a voltage of the second polarity to other conductive portions 352. A configuration in which a plurality of conductive portions 352 is provided is explained further below with reference to FIGS. 11 and 12.

Figure 8:
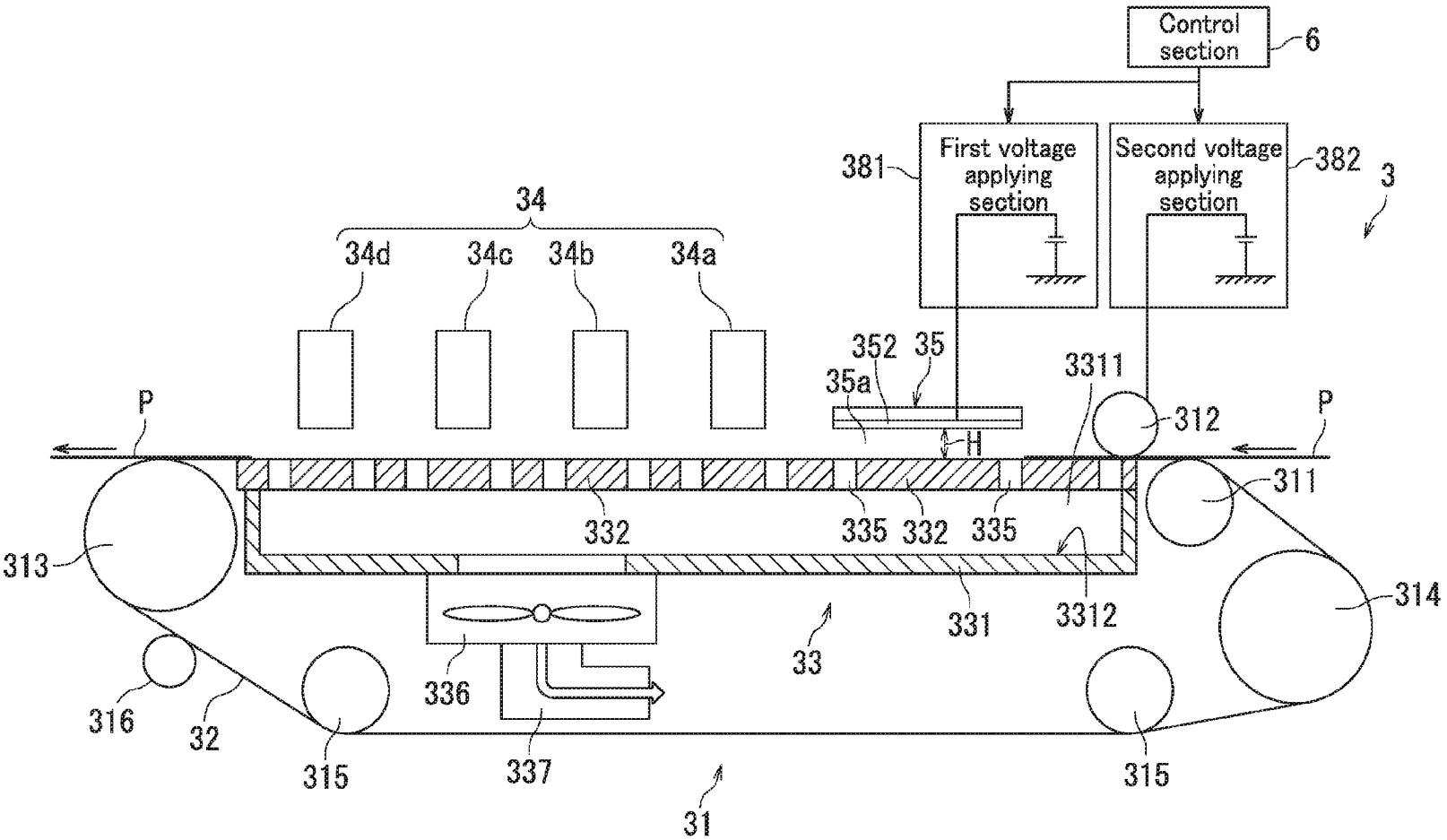
FIG. 8 illustrates a second example of configuration of the image forming section illustrated in FIG. 1.
Figure 9:
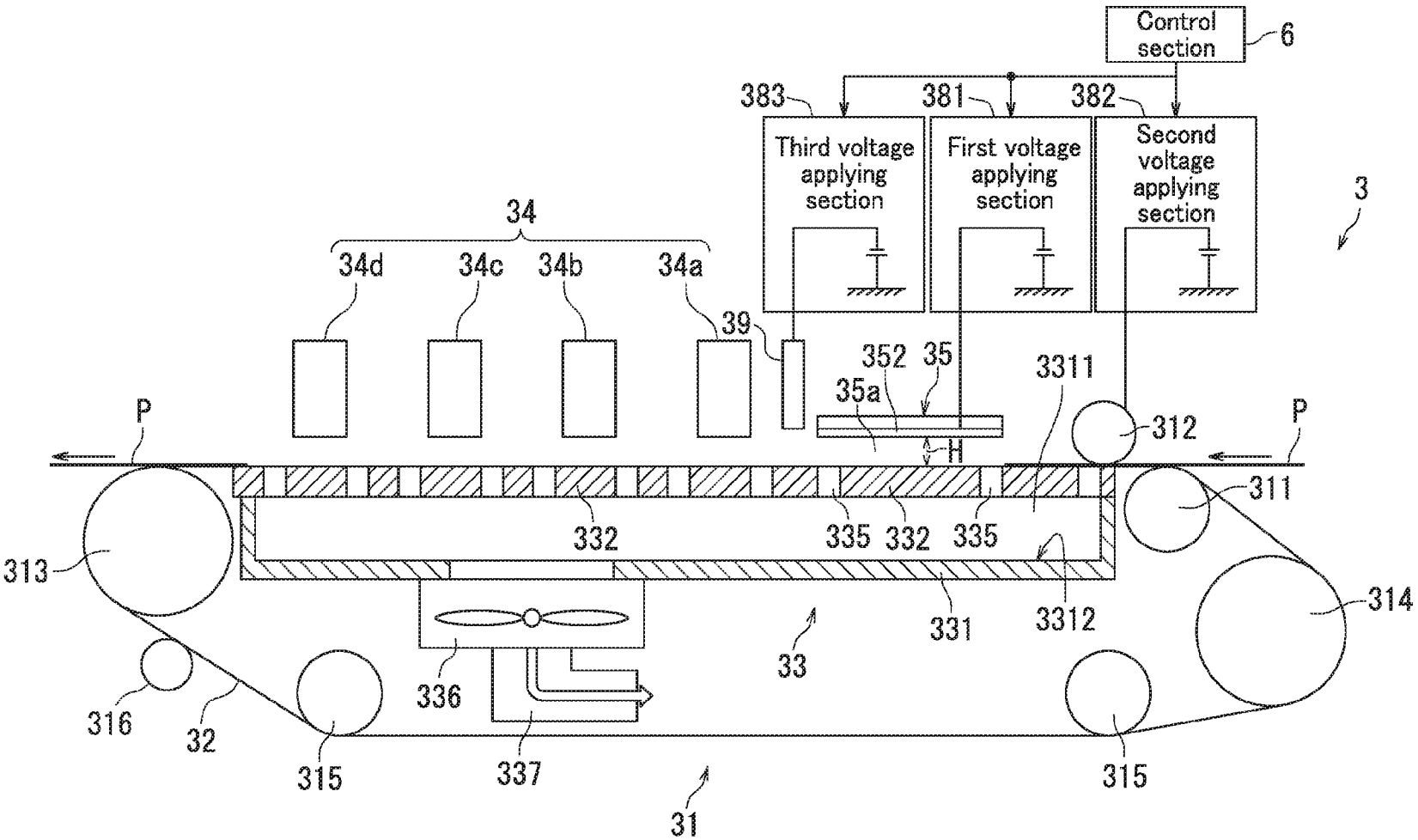
FIG. 9 illustrates a third example of configuration of the image forming section illustrated in FIG. 1.
Figure 11:
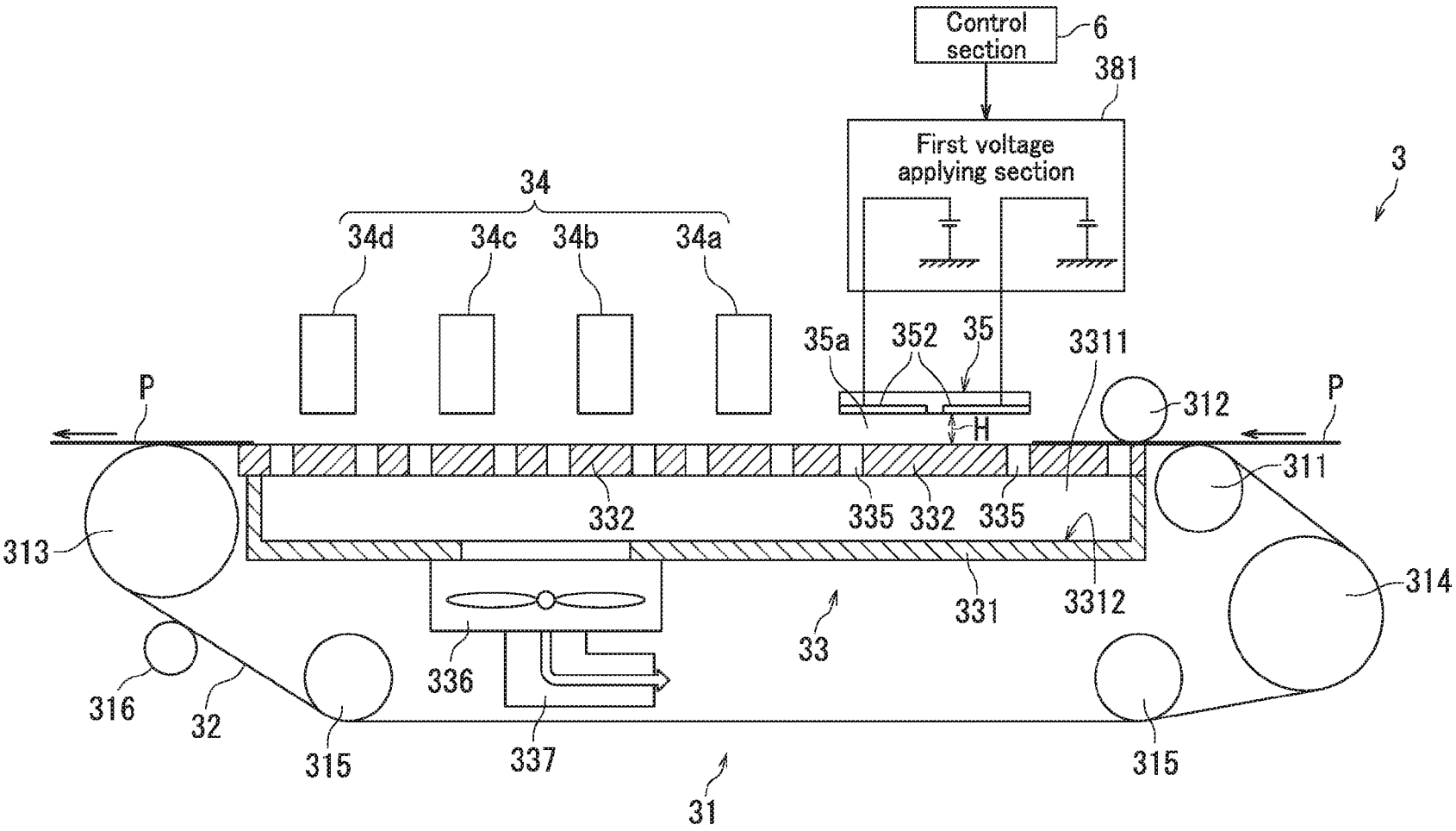
FIG. 11 illustrates a fourth example of configuration of the image forming section illustrated in FIG. 1.
Figure 12:
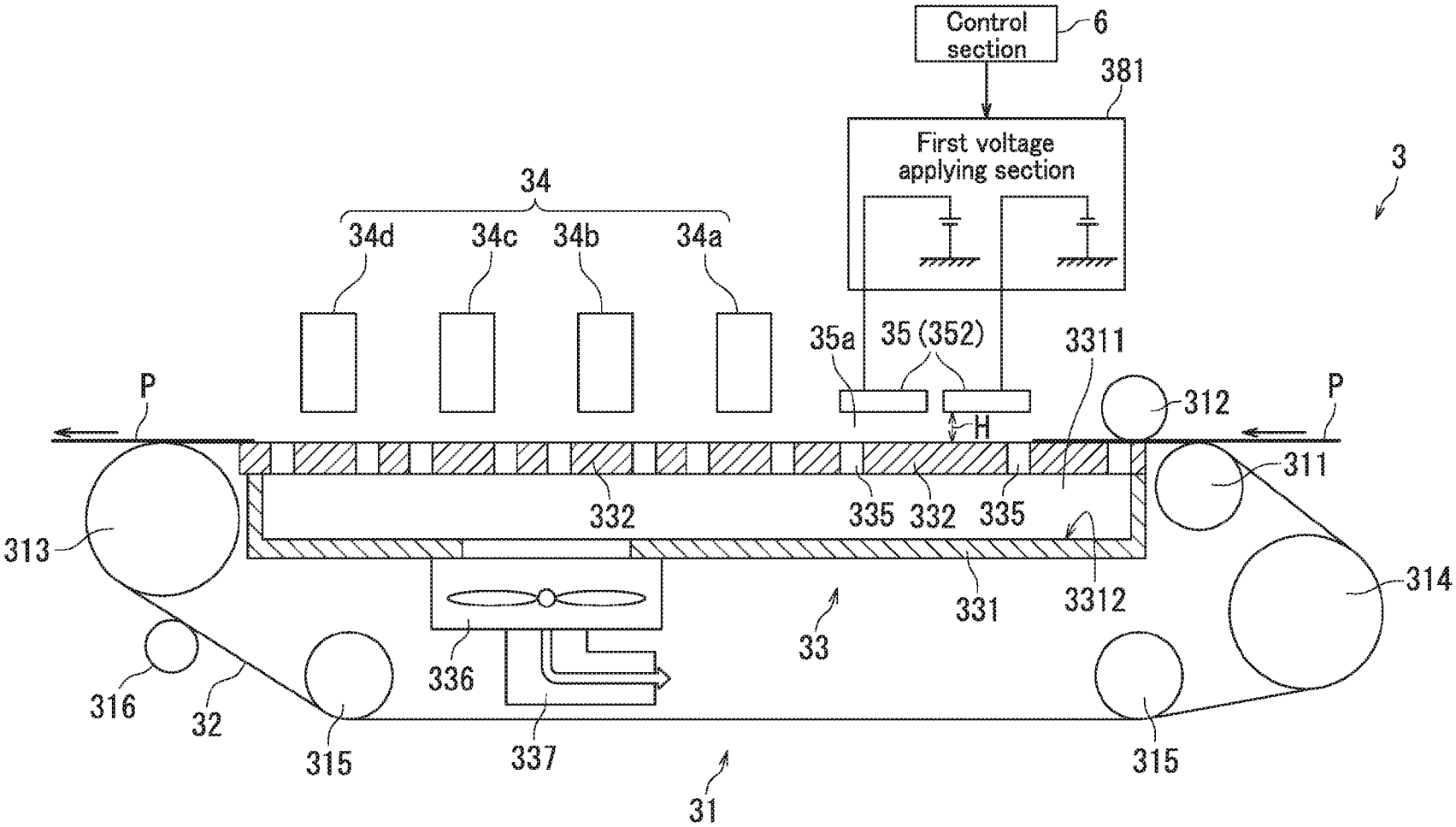
FIG. 12 illustrates a fifth example of configuration of the image forming section illustrated in FIG. 1.

In the first embodiment, the control section 6 controls the first voltage applying section 381 to apply a voltage to the conductive portion 352 while the inkjet recording apparatus 1 performs a specific target process. The specific target process corresponds to a specific process. In a configuration in which one conductive portion 352 is provided such as illustrated in FIGS. 2, 8, and 9, the control section 6 causes a voltage of the first polarity to be applied to the conductive portion 352. On the other hand, in a configuration in which a plurality of conductive portions 352 are provided such as illustrated in FIGS. 11 and 12, the control section causes a voltage of the first polarity to be applied to some conductive portions 352 and causes a voltage of the second polarity to be applied to other conductive portions 352. Herein, the target process is a process that is accompanied by driving of the conveyor belt 32 such as either or both of a process for forming an image on a sheet P (referred to below as an "image formation process") and a cleaning process. The following provides a specific example of timing of voltage application to the conductive portion 352 with reference to FIGS. 7A and 7B.

Figure 7A:
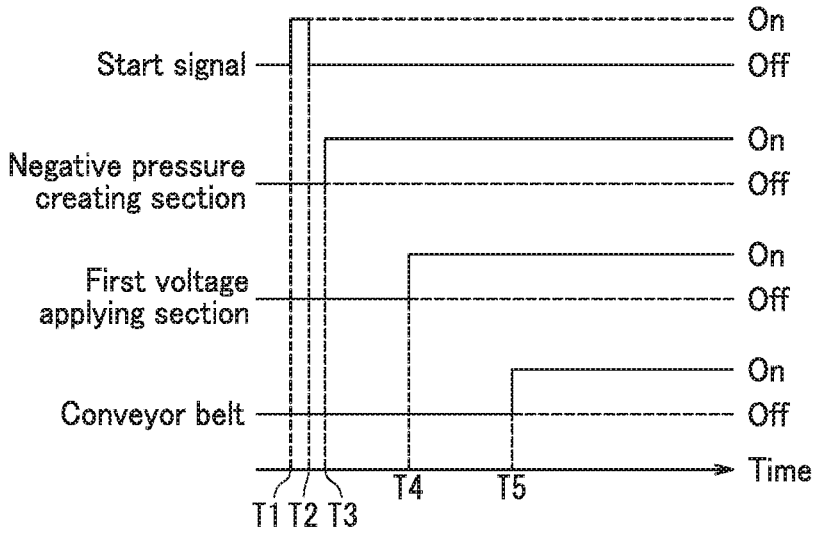
FIGS. 7A and 7B are timing charts illustrating operation of a control section illustrated in FIG. 1.
Figure 7B:
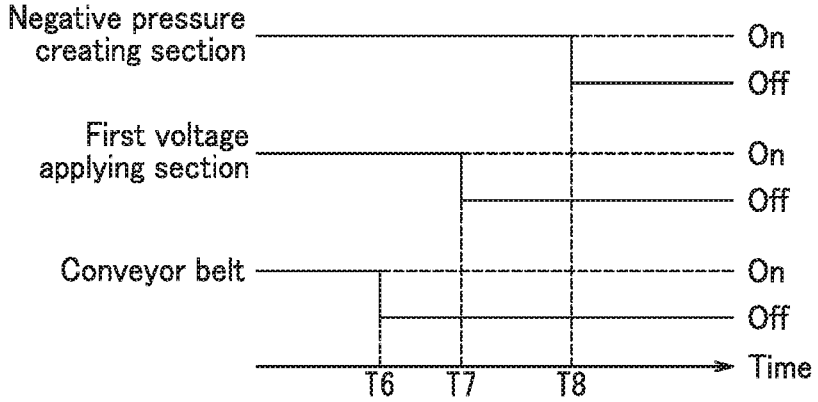

FIGS. 7A and 7B are timing charts illustrating operation of the control section 6 illustrated in FIG. 1.

The following first refers to FIG. 7A in order to explain operation of the control section 6 upon receiving an instruction to start the target process.

At time T1, a signal that instructs starting of the target process (start signal) is input to the control section 6. Thereafter, the control section 6 starts driving of the negative pressure creating section 336 at time T3 such that the negative pressure applying section 33 starts to apply negative pressure. A time interval between time T1 and time T3 is, for example, 100 msec.

Thereafter, the control section 6 causes the first voltage applying section 381 to start applying a voltage to the conductive portion 352 at time T4. A time interval between time T3 and time T4 is, for example, 500 msec.

Between time T3 and time T4, paper dust deposited on a sheet placement region of the conveyor belt 32, paper dust floating above the sheet placement region, and paper dust attached to the plate member 35 are sucked into and collected in the air flow chamber 331. The sheet placement region is a region of the conveyor belt 32 on which the sheet P is placed and is a region extending from a position at which the conveyor belt 32 is in contact with the belt-speed detecting roller 311, through a part of the conveyor belt 32 above the guide member 332, to a position at which the conveyor belt 32 is in contact with the drive roller 313. Between time T3 and time T4, attachment strength of paper dust to the plate member 35 is weak because a voltage is not yet applied to the conductive portion 352. Therefore, paper dust attached to the plate member 35 is readily sucked into the air flow chamber 331 through the negative pressure applied by the negative pressure applying section 33.

Thereafter, the control section 6 starts driving of the drive roller 313 at time T5 and thereby starts driving of the conveyor belt 32. A time interval between time T4 and time T5 is, for example, 1,000 msec. Between time T4 and time T5, paper dust remaining around the plate member 35 (paper dust attached to the plate member 35 and paper dust floating around the plate member 35) becomes strongly attached to the conductive portion 352.

Thereafter, the inkjet recording apparatus 1 performs the target process. More specifically, in a situation in which the target process is an image formation process, the control section 6 starts conveyance of a sheet P and controls the recording heads 34 to form an image on the sheet P. In a situation in which the target process is a cleaning process, the control section 6 remains on standby with the conveyor belt 32 in a driven state until a specific cleaning time (for example, a few minutes) has passed. While the control section 6 is on standby, paper dust attached to the conveyor belt 32 is collected through suction into the air flow chamber 331 or attachment to the conductive portion 352.

Thus, in the first embodiment, upon receiving an instruction to start the target process, the inkjet recording apparatus 1 performs the target process after performing processes (1) to (3), show below, in order.

Process (1): Starting application of negative pressure by the negative pressure applying section 33

Process (2): Starting application of a voltage to the conductive portion 352 by the first voltage applying section 381

Process (3): Starting driving of the conveyor belt 32

Through the above, paper dust such as paper dust deposited on the sheet placement region of the conveyor belt 32 and paper dust floating above the sheet placement region is collected through suction into the air flow chamber 331 or attachment to the conductive portion 352, before driving of the conveyor belt 32 starts. Therefore, the inkjet recording apparatus 1 can restrict occurrence of a problematic situation in which paper dust deposited on the conveyor belt 32 is stirred up by vibration of the conveyor belt 32 when driving of the conveyor belt 32 starts and becomes attached to the nozzles.

The following explains operation of the control section 6 once the target process ends with reference to FIG. 7B.

Once the target process ends at time T6, the control section 6 first stops driving of the drive roller 313 and thereby stops driving of the conveyor belt 32.

Thereafter, the control section 6 stops application of the voltage to the conductive portion 352 by the first voltage applying section 381 at time T7. A time interval between time T6 and time T7 is, for example, 500 msec.

Thereafter, the control section 6 stops driving of the negative pressure creating section 336 at time T8 and thereby stops application of the negative pressure by the negative pressure applying section 33. A time interval between time T7 and time T8 is, for example, 500 msec.

Thus, in the first embodiment, the control section 6 performs processes (4) to (6), shown below, in order once the target process ends.

Process (4): Stopping driving of the conveyor belt 32

Process (5): Stopping application of the voltage to the conductive portion 352 by the first voltage applying section 381

Process (6): Stopping application of the negative pressure by the negative pressure applying section 33

In other words, once the target process ends, the control section 6 stops driving of the conveyor belt 32 before stopping application of the voltage to the conductive portion 352 and before stopping application of the negative pressure by the negative pressure applying section 33. Through the above, the inkjet recording apparatus 1 can restrict occurrence of a problematic situation in which, after voltage application to the conductive portion 352 and negative pressure application by the negative pressure applying section 33 are stopped, paper dust is carried toward the recording heads 34 by air flow created due to driving of the conveyor belt 32 (drive air flow) and becomes attached to the nozzles.

FIG. 8 illustrates a second example of configuration of the image forming section 3 illustrated in FIG. 1.

In the example of configuration illustrated in FIG. 8, the image forming section 3 includes a second voltage applying section 382 in addition to the elements illustrated in FIG. 2. The second voltage applying section 382 applies a voltage of the second polarity (positive polarity in the first embodiment) to the placement roller 312—more specifically, the outer circumferential surface of the placement roller 312—under the control of the control section 6. For example, the second voltage applying section 382 applies a voltage of +1.5 kV to the placement roller 312.

As explained further above, the guide member 332 is grounded. Therefore, when the voltage is applied to the placement roller 312, current flows from the placement roller 312 to the guide member 332 via the conveyor belt 32 or via both the conveyor belt 32 and a sheet P. As a result, the sheet P and paper dust attached thereto are charged as the sheet P passes between the placement roller 312 and the guide member 332.

In the first embodiment, the control section 6 controls the second voltage applying section 382 to apply the voltage of the second polarity to the placement roller 312 while the voltage of the first polarity is being applied to the conductive portion 352.

Through the above, the inkjet recording apparatus 1 can charge a sheet P and paper dust attached thereto to the second polarity as the sheet P passes between the placement roller 312 and the guide member 332 through application of the voltage of the second polarity to the placement roller 312. Therefore, the inkjet recording apparatus 1 can more effectively remove the paper dust attached to the sheet P by causing the paper dust to attach to the conductive portion 352 of the plate member 35.

FIG. 9 illustrates a third example of configuration of the image forming section 3 illustrated in FIG. 1.

In the example of configuration illustrated in FIG. 9, the image forming section 3 includes a charge imparting section 39 and a third voltage applying section 383 in addition to the elements illustrated in FIG. 8.

The charge imparting section 39 is located further upstream in the conveyance direction of the sheet P than the recording heads 34 and further downstream in the conveyance direction of the sheet P than the plate member 35. The charge imparting section 39 imparts charge to the sheet P and the paper dust attached thereto as the sheet P passes below the charge imparting section 39. The charge imparted by the charge imparting section 39 is of the same polarity as a voltage applied thereto. Configuration of the charge imparting section 39 is explained further below with reference to FIG. 10.

The third voltage applying section 383 applies a voltage of the first polarity (negative polarity in the first embodiment) to the charge imparting section 39 under the control of the control section 6. For example, the third voltage applying section 383 applies a voltage of −3.0 kV to the charge imparting section 39.

In the first embodiment, the control section 6 controls the third voltage applying section 383 to apply the voltage of the first polarity to the charge imparting section 39 while a voltage of the first polarity is being applied to the conductive portion 352 and a voltage of the second polarity is being applied to the placement roller 312. In other words, while the voltage of the first polarity is being applied to the conductive portion 352 and the voltage of the second polarity is being applied to the placement roller 312, the charge imparting section 39 imparts charge of the first polarity to the sheet P and the paper dust attached thereto as the sheet P passes below the charge imparting section 39.

Through the above, the inkjet recording apparatus 1 can charge the sheet P and the paper dust to the second polarity while the sheet P and the paper dust pass between the placement roller 312 and the guide member 332 and can subsequently charge the sheet P and the paper dust to the first polarity, such that the paper dust tends not to attach to the nozzles, by imparting charge of the first polarity to the sheet P and the paper dust at a location further upstream in the conveyance direction of the sheet P than the recording heads 34 and further downstream in the conveyance direction of the sheet P than the plate member 35. Therefore, the inkjet recording apparatus 1 can restrict occurrence of a problematic situation in which paper dust charged to the second polarity, which tends to readily attach to the nozzles, is carried below the recording heads 34 while still charged to the second polarity.

Figure 10A:
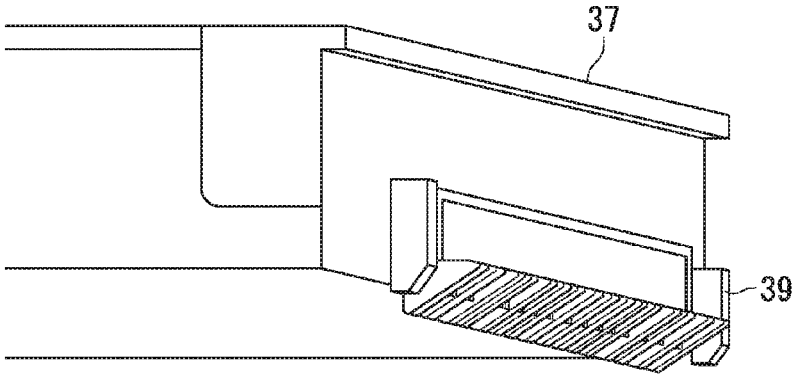
FIGS. 10A and 10B illustrate configuration of a charge imparting section illustrated in FIG. 9.
Figure 10B:
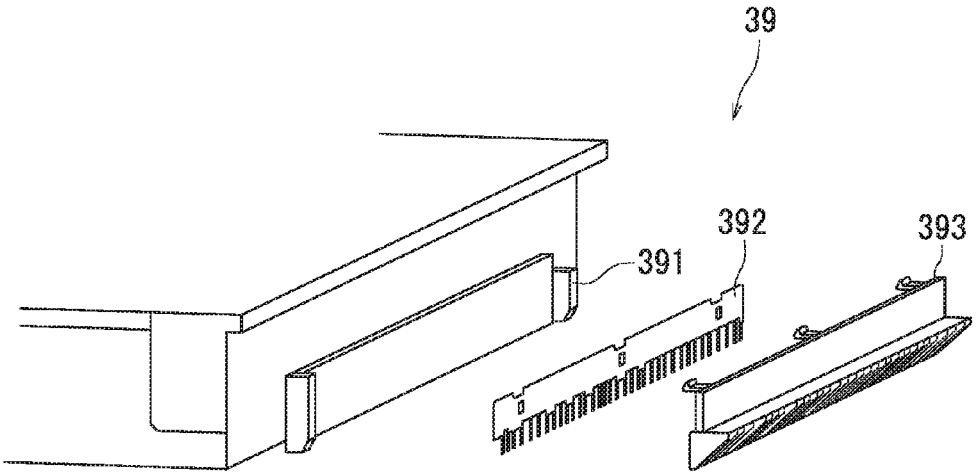

FIGS. 10A and 10B illustrate configuration of the charge imparting section 39 illustrated in FIG. 9. FIG. 10A is a perspective view of the charge imparting section 39. FIG. 10B is an exploded view of the charge imparting section 39.

As illustrated in FIG. 10A, the charge imparting section 39 is fixed to the head base 37. FIG. 10B illustrates that the charge imparting section 39 includes an attachment base 391, an electrode 392, and a sheet guide 393.

The attachment base 391 is a base to which the electrode 392 and the sheet guide 393 are attached and is fixed to the head base 37. The sheet guide 393 guides a conveyed sheet P below the charge imparting section 39. The attachment base 391 and the sheet guide 393 are for example made from an insulating resin.

The electrode 392 imparts charge of the first polarity to the sheet P and paper dust PD passing below the electrode 392. The electrode 392 is for example a needle electrode that is made from a metal such as stainless steel. The electrode 392 is supported between the attachment base 391 and the sheet guide 393. Discharge occurs between the electrode 392 and the guide member 332 when a voltage of the first polarity is applied to the electrode 392 by the third voltage applying section 383. As a result, charge of the first polarity is imparted to the sheet P and the paper dust PD passing below the electrode 392.

FIG. 11 illustrates a fourth example of configuration of the image forming section 3 illustrated in FIG. 1.

In the example of configuration illustrated in FIG. 11, the plate member 35 includes a plurality of conductive portions 352 (two in the first embodiment). The conductive portions 352 are arranged at specific intervals in the conveyance direction of the sheet P.

The interval between adjacent conductive portions 352 among the plurality of conductive portions 352 is set such that electrical interference does not occur when voltages are applied to the adjacent conductive portions 352. The conductive portions 352 may each have the same length in the conveyance direction of the sheet P (referred to below simply as the "length of the conductive portion 352") or may have different lengths. The length of each of the conductive portions 352 may for example be determined based on charging characteristics of paper dust that is conveyed to below the plate member 35 while attached to a sheet P. For example, in a situation in which the majority of paper dust conveyed while attached to the sheet P is charged to the second polarity, the length of a conductive portion 352 having an applied voltage of the first polarity may be set as longer than the length of a conductive portion 352 having an applied voltage of the second polarity.

The first voltage applying section 381 applies a voltage to each of the conductive portions 352 under the control of the control section 6 such that voltages of different polarities are applied to adjacent conductive portions 352 among the plurality of conductive portions 352. More preferably, the first voltage applying section 381 applies a voltage of the first polarity to a conductive portion 352 that is furthest upstream in the conveyance direction of the sheet P (furthest rightward in FIG. 11) among the plurality of conductive portions 352. For example, in the example illustrated in FIG. 11, the first voltage applying section 381 applies a voltage of the first polarity to a conductive portion 352 located on the right-hand side and applies a voltage of the second polarity to a conductive portion 352 located on the left-hand side.

The control section 6 controls the first voltage applying section 381 in the same manner as explained with reference to FIGS. 2 and 7. In other words, the control section 6 controls the first voltage applying section 381 to apply a voltage (voltage of the first polarity or the second polarity) to each of the conductive portions 352 while the inkjet recording apparatus 1 performs the target process.

More specifically, upon receiving an instruction for starting the target process, the inkjet recording apparatus 1 performs the target process after performing the processes (1) to (3), described further above, in order. In the example of configuration illustrated in FIG. 11, the control section 6 causes the first voltage applying section 381 to start applying a voltage to each of the conductive portions 352 in the process (2). The control section 6 performs the processes (4) to (6), described further above, in order once the target process ends. In the example of configuration illustrated in FIG. 11, the control section 6 causes the first voltage applying section 381 to stop applying the voltage to each of the conductive portions 352 in the process (5).

Through the above, the inkjet recording apparatus 1 can cause not only paper dust charged to the second polarity (positive polarity in the first embodiment), which tends to readily attach to the nozzles, but also paper dust charged to the first polarity (negative polarity in the first embodiment) to attach to the conductive portions 352 of the plate member 35 by applying voltages of different polarities (first polarity and second polarity) to the conductive portions 352. In other words, the inkjet recording apparatus 1 can effectively collect paper dust upstream of the recording heads 34 in the conveyance direction of the sheet P, regardless of whether the paper dust is charged to the first polarity or the second polarity. Therefore, the inkjet recording apparatus 1 can reduce the amount of paper dust that is carried to below the recording heads 34 and can effectively restrict the paper dust from attaching to the nozzles.

FIG. 12 illustrates a fifth example of configuration of the image forming section 3 illustrated in FIG. 1.

In the example of configuration illustrated in FIG. 12, the image forming section 3 includes a plurality of plate members 35 (two in the first embodiment). The plate members 35 are arranged at specific intervals in the conveyance direction of the sheet P. In the example of configuration illustrated in FIG. 12, each of the plate members 35 is entirely composed of a conductive portion 352.

The interval between adjacent plate members 35 among the plurality of plate members 35 is set such that electrical interference does not occur when voltages are applied to the adjacent plate members 35 (conductive portions 352). The plate members 35 may each have the same length in the conveyance direction of the sheet P (referred to below simply as the "length of the plate member 35") or may have different lengths. The length of each of the plate members 35 may for example be determined based on charging characteristics of paper dust that is conveyed to below the plate members 35 while attached to a sheet P. For example, in a situation in which the majority of paper dust conveyed while attached to the sheet P is charged to the second polarity, the length of a plate member 35 having an applied voltage of the first polarity may be set as longer than the length of a plate member 35 having an applied voltage of the second polarity.

The first voltage applying section 381 applies a voltage to each of the plate members 35 under the control of the control section 6 such that voltages of different polarities are applied to adjacent plate members 35 among the plurality of plate members 35. More preferably, the first voltage applying section 381 applies a voltage of the first polarity to a plate member 35 that is furthest upstream in the conveyance direction of the sheet P (furthest rightward in FIG. 12) among the plurality of plate members 35. For example, in the example illustrated in FIG. 12, the first voltage applying section 381 applies a voltage of the first polarity to a plate member 35 located on the right-hand side and applies a voltage of the second polarity to a plate member 35 located on the left-hand side.

The control section 6 controls the first voltage applying section 381 in the same manner as explained with reference to FIGS. 2 and 7. In other words, the control section 6 controls the first voltage applying section 381 to apply a voltage (voltage of the first polarity or the second polarity) to each of the plate members 35 while the inkjet recording apparatus 1 performs the target process.

More specifically, upon receiving an instruction for starting the target process, the inkjet recording apparatus 1 performs the target process after performing the processes (1) to (3), described further above, in order. In the example of configuration illustrated in FIG. 12, the control section 6 causes the first voltage applying section 381 to start applying a voltage to each of the plate members 35 in the process (2). The control section 6 performs the processes (4) to (6), described further above, in order once the target process ends. In the example of configuration illustrated in FIG. 12, the control section 6 causes the first voltage applying section 381 to stop applying the voltage to each of the plate members 35 in the process (5).

Through the above, the inkjet recording apparatus 1 can apply voltages of different polarities (first polarity or second polarity) to the plate members 35 and, as a result, can cause paper dust that is charged to the first polarity (negative polarity in the first embodiment) to attach to the plate member 35 having an applied voltage of the second polarity, and can cause paper dust that is charged to the second polarity (positive polarity in the first embodiment) to attach to the plate member 35 having an applied voltage of the first polarity. In other words, the inkjet recording apparatus 1 can effectively collect paper dust upstream of the recording heads 34 in the conveyance direction of the sheet P, regardless of whether the paper dust is charged to the first polarity or the second polarity. Therefore, the inkjet recording apparatus 1 can reduce the amount of paper dust that is carried to below the recording heads 34 and can effectively restrict the paper dust from attaching to the nozzles.

Through the above, the first embodiment of the present disclosure has been explained with reference to the drawings. However, the present disclosure is not limited by the above first embodiment and can be implemented in various forms without deviating from the essence of the present disclosure (for example, as explained below in sections (1)-(5)). The drawings schematically illustrate elements in order to facilitate understanding. Properties of the elements illustrated in the drawings, such as thickness, length, and quantity, may differ from reality in order to facilitate preparation of the drawings. Furthermore, properties of the elements described in the above embodiment, such as shape and dimensions, are merely examples and are not intended to be specific limitations. Such properties can be changed without substantially deviating from the configuration of the present disclosure.

(1) In the example of configuration illustrated in FIG. 9, the image forming section 3 includes the charge imparting section 39, the second voltage applying section 382, and the third voltage applying section 383, but the second voltage applying section 382 may be omitted. In other words, the control section 6 may cause a voltage of the first polarity to be applied to the charge imparting section 39 while a voltage of the first polarity is applied to the conductive portion 352, without causing a voltage to be applied to the placement roller 312.

(2) In the example of configuration illustrated in FIG. 12, each of the conductive portions 352 composes the entirety of the corresponding plate member 35, but the conductive portion 352 may alternatively compose part of the plate member 35. In such a configuration, the first voltage applying section 381 applies a voltage to the conductive portion 352 of each of the plate members 35 under the control of the control section 6 such that voltages of different polarities are applied to the respective conductive portions 352 of adjacent plate members 35 among the plurality of plate member 35.

(3) Although the first embodiment is explained for a configuration in which the sheet P is conveyed by the conveyor belt 32 in the image forming section 3, in an alternative configuration, the sheet P may be conveyed by a different method in the image forming section 3. For example, in an alternative configuration, the sheet P may be conveyed by conveyance rollers. In such a configuration, negative pressure is preferably applied from between adjacent conveyance rollers.

(4) Although the first embodiment is explained for a configuration in which the narrow gap 35*a* is formed by the plate member 35, in an alternative configuration, the narrow gap 35*a* may be formed in a different manner. For example, in an alternative configuration, the head base 37 may extend toward the conveyor belt 32 at a position upstream of the recording heads 34 in the conveyance direction of the sheet P and may thereby form the narrow gap 35*a*. The above configuration can simplify structure.

In another alternative example, the narrow gap 35*a* may be formed by a belt stretched around two rollers instead of by the plate member 35. More specifically, a drive roller and a driven roller that are substantially parallel to the upper surface of the conveyor belt 32 and an endless belt stretched around the drive roller and the driven roller are provided such that a lower surface of the endless belt forms the narrow gap 35*a* in conjunction with the upper surface of the conveyor belt 32. When paper dust becomes attached to the lower surface of the endless belt, the endless belt can be driven to circulate such that a surface section to which paper dust is not attached becomes positioned as the lower surface, and thereby the frequency with which a servicing technician, for example, needs to remove paper dust attached to the endless belt can be reduced.

(5) Although the first embodiment is explained for a configuration in which the guide member 332 and the air flow chamber 331 are separate elements, in an alternative configuration, the guide member 332 and the air flow chamber 331 may be integrated together. In such a configuration, leakage of negative pressure from the air flow chamber 331 (i.e., inflow of air to the air flow chamber 331 through a gap between the guide member 332 and the air flow chamber 331) can be prevented.

Second Embodiment

Figure 13:
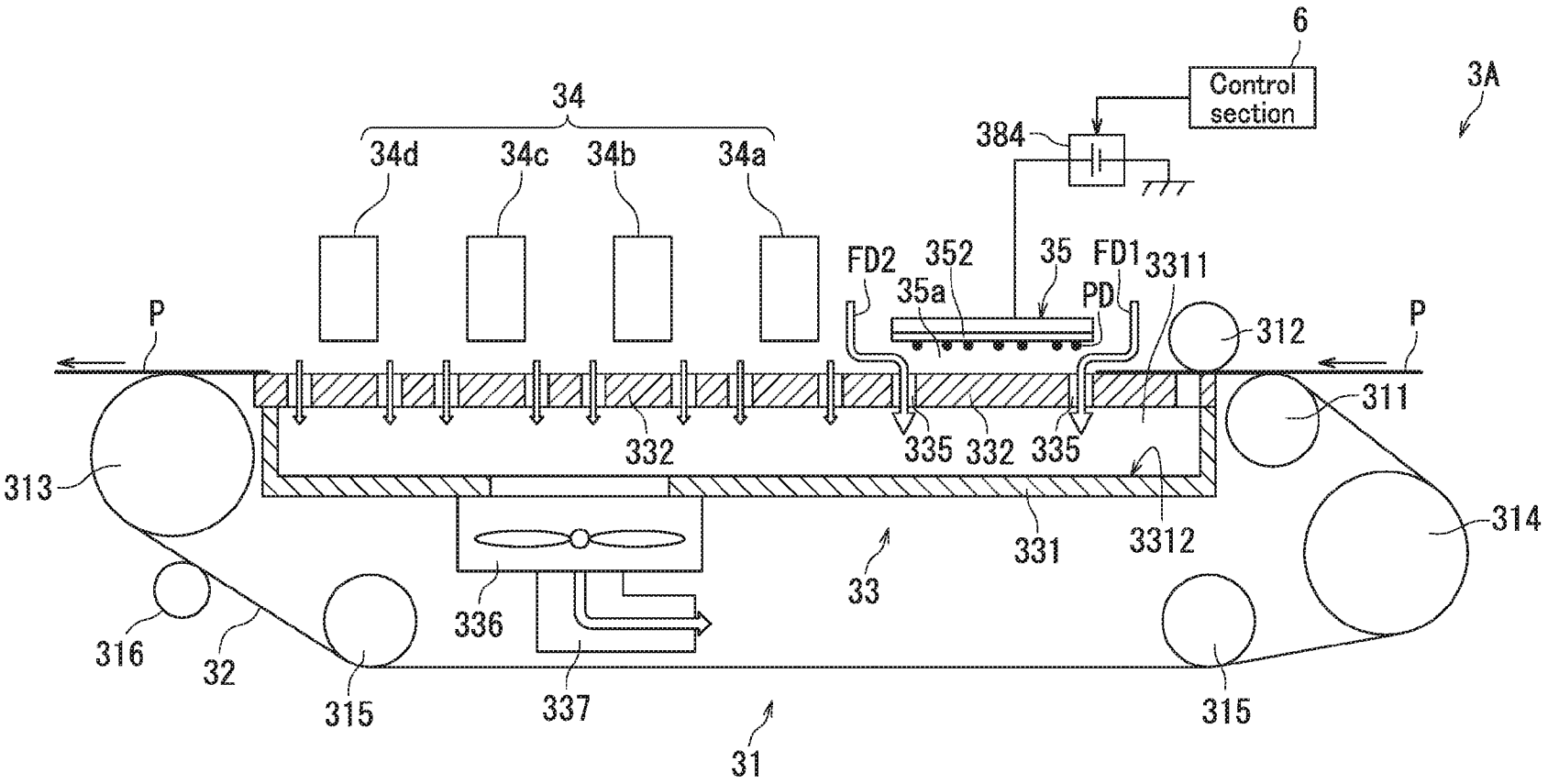
FIG. 13 illustrates an image forming section according to a second embodiment.

The following explains an image forming section 3A according to a second embodiment with reference to FIG. 13. The image forming section 3A according to the second embodiment differs from the image forming section 3 (refer to FIG. 2) according to the first embodiment in terms of the polarity of voltage applied to the plate member 35. First, a cleaning mechanism of the plate member 35 is explained. FIG. 13 illustrates the cleaning mechanism of the plate member 35. The cleaning mechanism of the plate member 35 includes the control section 6, a fourth voltage applying section 384, and the negative pressure applying section 33. The inkjet recording apparatus 1 explained with reference to FIG. 1 further includes the fourth voltage applying section 384. The fourth voltage applying section 384 is equivalent to an example of a "first voltage applying section".

The cleaning mechanism of the plate member 35 causes paper dust PD to detach from the plate member 35. In the following explanation, an operation of the cleaning mechanism of the plate member 35 is referred to as a cleaning operation of the plate member 35.

The cleaning operation of the plate member 35 is performed in order to restrict attachment of paper dust PD to the nozzles as a consequence of attachment of the paper dust PD to the plate member 35. More specifically, contact between a sheet P and the lower surface of the plate member 35 does not generally occur because the sheet P is held on the conveyor belt 32 by suction while being conveyed. However, in the case of a curled sheet P, for example, a curled portion of the sheet P may not be held on the conveyor belt 32 by suction. Therefore, the curled sheet P may come into contact with the lower surface of the plate member 35 while being conveyed. In such a situation, if paper dust PD is attached to the lower surface of the plate member 35, the paper dust PD may be scraped off from the plate member 35. There is a possibility of the scraped-off paper dust PD being carried to the nozzles of the recording heads 34 by air flowing in the conveyance direction of the sheet P and becoming attached to the nozzles. There is also a possibility of the scraped-off paper dust PD becoming attached to a sheet P once again, being conveyed to below the recording heads 34, and becoming attached to the nozzles. Furthermore, as the amount of paper dust PD attached to the plate member 35 increases, attachment strength of the paper dust PD to the plate member 35 becomes weaker and, as a result, the paper dust PD may detach from the plate member 35. If paper dust PD detaches from the plate member 35 during recording of an image on a sheet P, there is a possibility of the paper dust PD being carried to the nozzles of the recording heads 34 by air flowing in the conveyance direction of the sheet P. There is also a possibility of the detached paper dust PD becoming attached to a sheet P passing under the plate member 35 or becoming attached to the outer circumferential surface of the conveyor belt 32, and being conveyed to below the recording heads 34. Therefore, attachment of paper dust PD to the nozzles may occur as a consequence of the paper dust PD becoming attached to the plate member 35. A cleaning operation of the plate member 35 is performed in order to address the problem described above. The cleaning operation of the plate member 35 includes an operation of applying a voltage to the plate member 35 by the fourth voltage applying section 384 and a suction operation by the negative pressure applying section 33. In the following explanation, the operation of applying the voltage to the plate member 35 by the fourth voltage applying section 384 is referred to as a voltage application operation by the fourth voltage applying section 384.

The fourth voltage applying section 384 applies a voltage to the plate member 35. In the second embodiment, the fourth voltage applying section 384 applies a direct current voltage of positive polarity to the plate member 35. The control section 6 controls the voltage application operation by the fourth voltage applying section 384. More specifically, the control section 6 controls a start timing of the voltage application operation by the fourth voltage applying section 384. The control section 6 also controls an end timing of the voltage application operation by the fourth voltage applying section 384. In other words, the control section 6 controls a voltage application time of the fourth voltage applying section 384. In the following explanation, the voltage applied to the plate member 35 by the fourth voltage applying section 384 is referred to as an application voltage of the fourth voltage applying section 384.

The fourth voltage applying section 384 can weaken attachment strength of paper dust PD attached to the plate member 35 by applying the voltage to the plate member 35. In other words, Coulomb forces (image forces) attaching the paper dust PD to the plate member 35 can be weakened. More specifically, when the fourth voltage applying section 384 applies the direct current voltage to the plate member 35, the charge of paper dust PD charged to opposite polarity to the polarity of the direct current voltage is reduced. Therefore, the attachment strength of the paper dust PD charged to opposite polarity to a polarity of the application voltage of the fourth voltage applying section 384 can be weakened. In the second embodiment, a direct current voltage of positive polarity is applied to the plate member 35. Therefore, attachment strength of paper dust PD charged to negative polarity can be weakened. The paper dust PD having reduced charge tends to detach more readily from the plate member 35.

The negative pressure applying section 33 performs the suction operation in accordance with the voltage application operation by the fourth voltage applying section 384. In other words, the negative pressure creating section 336 is driven in accordance with the voltage application operation by the fourth voltage applying section 384. The control section 6 controls the suction operation by the negative pressure applying section 33. Upon driving of the negative pressure creating section 336, air flow is created in the narrow gap 35*a* as described further above. The air flow causes paper dust PD having reduced charge, and thus weakened attachment strength, to detach from the plate member 35. In the second embodiment, paper dust PD charged to negative polarity that is attached to the plate member 35 detaches from the plate member 35. The detached paper dust PD is sucked toward the air flow chamber 331. The paper dust PD passes through the air flow chamber 331 and is ejected externally via the negative pressure creating section 336 and the duct 337. Therefore, according to the second embodiment, attachment of paper dust PD to the nozzles as a consequence of the paper dust PD becoming attached to the plate member 35 can be restricted.

The negative pressure applying section 33 preferably starts the suction operation at the same time as the voltage application operation by the fourth voltage applying section 384. More preferably, the negative pressure applying section 33 starts the suction operation before the voltage application operation by the fourth voltage applying section 384. Through the above, paper dust PD can be more reliably caused to detach from the plate member 35. More specifically, depending on the voltage application time of the fourth voltage applying section 384, paper dust PD that is charged to opposite polarity to the polarity of the application voltage of the fourth voltage applying section 384 may become charged to the same polarity as the application voltage of the fourth voltage applying section 384 and, as a result, attachment strength (Coulomb forces) of the paper dust PD may become stronger. In consideration of the above, so long as the suction operation by the negative pressure applying section 33 is started by the time that the voltage application operation by the fourth voltage applying section 384 starts, paper dust PD can be caused to detach from the plate member 35 before attachment strength of the paper dust PD becomes stronger.

The cleaning operation of the plate member 35 is performed during a non-recording period. In other words, the cleaning operation of the plate member 35 is performed during a period when image recording is not being performed on a sheet P. As explained above, if paper dust PD detaches from the plate member 35 during a period in which image recording is being performed on a sheet P, the detached paper dust PD may attach to the nozzles as a consequence of, for example, attaching to the sheet P. In consideration of the above, a situation in which paper dust PD detaches from the plate member 35 and attaches to the nozzles can be restricted by performing the cleaning operation of the plate member 35 during the non-recording period.

The voltage value of the application voltage of the fourth voltage applying section 384 is preset in accordance with a material from which the plate member 35 is made. Furthermore, ambient conditions (temperature and humidity) around the plate member 35 may be taken into account in setting of the voltage value of the application voltage of the fourth voltage applying section 384. Material properties of paper dust PD may also be taken into account in setting of the voltage value of the application voltage of the fourth voltage applying section 384. Furthermore, in a situation in which the cleaning operation of the plate member 35 is performed periodically, the amount of paper dust PD attached to the plate member 35 may be taken into account in setting of the voltage value of the application voltage of the fourth voltage applying section 384. The amount of paper dust PD attached to the plate member 35 varies depending on factors such as conveyance speed of a sheet P by the sheet conveyance section 4 (refer to FIG. 1), conveyance speed of the sheet P by the conveyance section 31, and the distance H between the plate member 35 and the sheet P (refer to FIG. 2). The voltage value of the application voltage of the fourth voltage applying section 384 is, for example, +5 V.

The voltage application time of the fourth voltage applying section 384 is preset in accordance with the material from which the plate member 35 is made. Furthermore, ambient conditions (temperature and humidity) around the plate member 35 may be taken into account in setting of the voltage application time of the fourth voltage applying section 384. Material properties of paper dust PD may also be taken into account in setting of the voltage application time of the fourth voltage applying section 384. Furthermore, in a situation in which the cleaning operation of the plate member 35 is performed periodically, the amount of paper dust PD attached to the plate member 35 may be taken into account in setting of the voltage application time of the fourth voltage applying section 384. As explained further above, the charging polarity of paper dust PD may change depending on the voltage application time of the fourth voltage applying section 384 and, as a result, attachment strength (Coulomb forces) of the paper dust PD may become stronger once again. Therefore, the voltage application time by the fourth voltage applying section 384 is preferably set such that the charging polarity of the paper dust PD does not change. The voltage application time of the fourth voltage applying section 384 is, for example, 5 seconds.

The conveyor belt 32 preferably circulates in accordance with the voltage application operation by the fourth voltage applying section 384. Through the above, a situation in which paper dust PD attachment becomes concentrated on one section of the surface of the conveyor belt 32 can be restricted. The control section 6 controls circulation of the conveyor belt 32. In the second embodiment, the conveyor belt 32 circulates while the suction operation is being performed by the negative pressure applying section 33. The conveyor belt 32 may start circulating before the negative pressure applying section 33 starts the suction operation or may start circulating at the same time as the negative pressure applying section 33 starts the suction operation.

The cleaning operation of the plate member 35 is preferably performed periodically. Periodic performance of the cleaning operation reduces the probability of a situation occurring in which paper dust PD detaches from the plate member 35 during image recording on a sheet P and subsequently attaches to the nozzles. More specifically, the cleaning operation of the plate member 35 may be performed each time image recording is performed for a specific number of sheets P (specific number of recording media). For example, the cleaning operation of the plate member 35 may be performed each time the number of sheets P on which recording has been performed reaches 1,000. An interval between performances of the cleaning operation of the plate member 35 may be set freely by a user.

In the second embodiment, the cleaning operation of the plate member 35 is performed in accordance with a maintenance time of the recording heads 34. Maintenance of the recording heads 34 is performed at a preset time. For example, maintenance of the recording heads 34 is performed when the inkjet recording apparatus 1 is powered up. Maintenance of the recording heads 34 is also performed each time image recording is performed on a specific number of sheets P (specific number of recording media). Image recording is not performed on a sheet P during maintenance of the recording heads 34.

During maintenance of the recording heads 34, a process is performed for maintenance of the recording heads 34, such as a purging and wiping process. The purging and wiping process involves a purging operation and a subsequent wiping operation. In the purging operation, ink is supplied to the recording heads 34 and ink (purged ink) is forced out (purged) from the nozzles (ink ejection outlets) of the recording heads 34. In the wiping operation, nozzle surfaces of the recording heads 34 (surfaces in which the nozzles are present) are wiped by a cleaning blade (not illustrated) to clean the nozzle surfaces.

The conveyance section 31, the guide member 332, and the negative pressure applying section 33 are lowered away from the recording heads 34 (head base 37) during maintenance of the recording heads 34. Therefore, the control section 6 causes the cleaning operation of the plate member 35 to be performed before the process for maintenance of the recording heads 34 is performed. Alternatively, the control section 6 may cause the cleaning operation of the plate member 35 to be performed once the process for maintenance of the recording heads 34 has been performed and the conveyance section 31, the guide member 332, and the negative pressure applying section 33 have returned to initial positions thereof.

Figure 14:
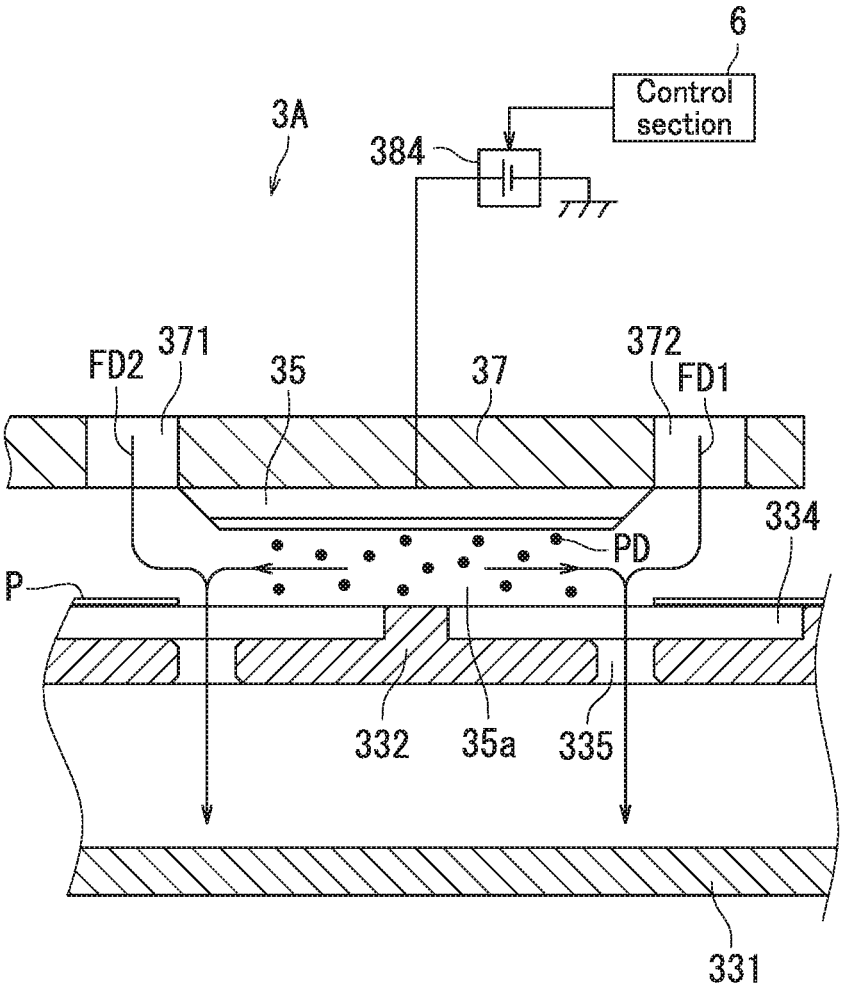
FIG. 14 illustrates a cleaning operation of a plate member according to the second embodiment.

The following explains the cleaning operation of the plate member 35 with reference to FIG. 14. FIG. 14 illustrates the cleaning operation of the plate member 35.

In the second embodiment, circulation of the conveyor belt 32 starts before the voltage application operation by the fourth voltage applying section 384. The negative pressure applying section 33 also starts the suction operation. Through the above, air flow along arrows FD1 and FD2 is created in the same way as explained for the first embodiment with reference to FIG. 3. Thereafter, the fourth voltage applying section 384 applies a direct current voltage to the plate member 35. As a result, paper dust PD having reduced charge, and thus having weakened attachment strength, detaches from the plate member 35 due to air flowing in the narrow gap 35*a* (air currents inside the narrow gap 35*a*). The detached paper dust PD is guided from the suction holes 321 below the plate member 35 into the grooves 334 below the plate member 35, and is then guided into the air flow chamber 331 via the through holes 335 corresponding to the grooves 334. The paper dust PD passes through the air flow chamber 331 and is discharge externally via the negative pressure creating section 336 and the duct 337.

According to the second embodiment, paper dust PD can be restricted from attaching to the nozzles of the recording heads 34 through a simple configuration as described above. In addition, paper dust PD can be caused to detach from the plate member 35 through the fourth voltage applying section 384 applying a voltage to the plate member 35 and through the negative pressure applying section 33 performing the suction operation. Through the above, attachment of paper dust PD to the nozzles as a consequence of the paper dust PD becoming attached to the plate member 35 can be restricted.

At least the lower surface of the plate member 35 is made from a conductor. Through the above configuration, charged paper dust has a lower tendency to attach to the plate member 35. Therefore, attachment of paper dust PD to the nozzles as a consequence of the paper dust PD becoming attached to the plate member 35 can be restricted.

In the second embodiment, air can flow smoothly into the narrow gap 35*a* because the holes 371 and 372 are provided in the head base 37.

Furthermore, in the second embodiment, the cleaning operation of the plate member 35 is performed periodically. Periodic performance of the cleaning operation reduces the probability of a situation occurring in which paper dust PD detaches from the plate member 35 during image recording on a sheet P and subsequently attaches to the nozzles.

Although the second embodiment is explained for a configuration in which a direct current voltage of positive polarity is applied to the plate member 35, in an alternative configuration, the fourth voltage applying section 384 may apply a direct current voltage of negative polarity to the plate member 35. In such a configuration, attachment strength of paper dust PD charged to positive polarity is weakened. Consequently, the paper dust PD charged to positive polarity detaches from the plate member 35.

<Variation of Second Embodiment>

The following explains a variation of the second embodiment. However, only matter that is different from the second embodiment is explained and explanation of matter that is the same as the second embodiment is omitted. An inkjet recording apparatus 1 according to the variation differs from the second embodiment in terms of configuration of a fifth voltage applying section 385. The fifth voltage applying section 385 is equivalent to an example of a "first voltage applying section."

Figure 15:
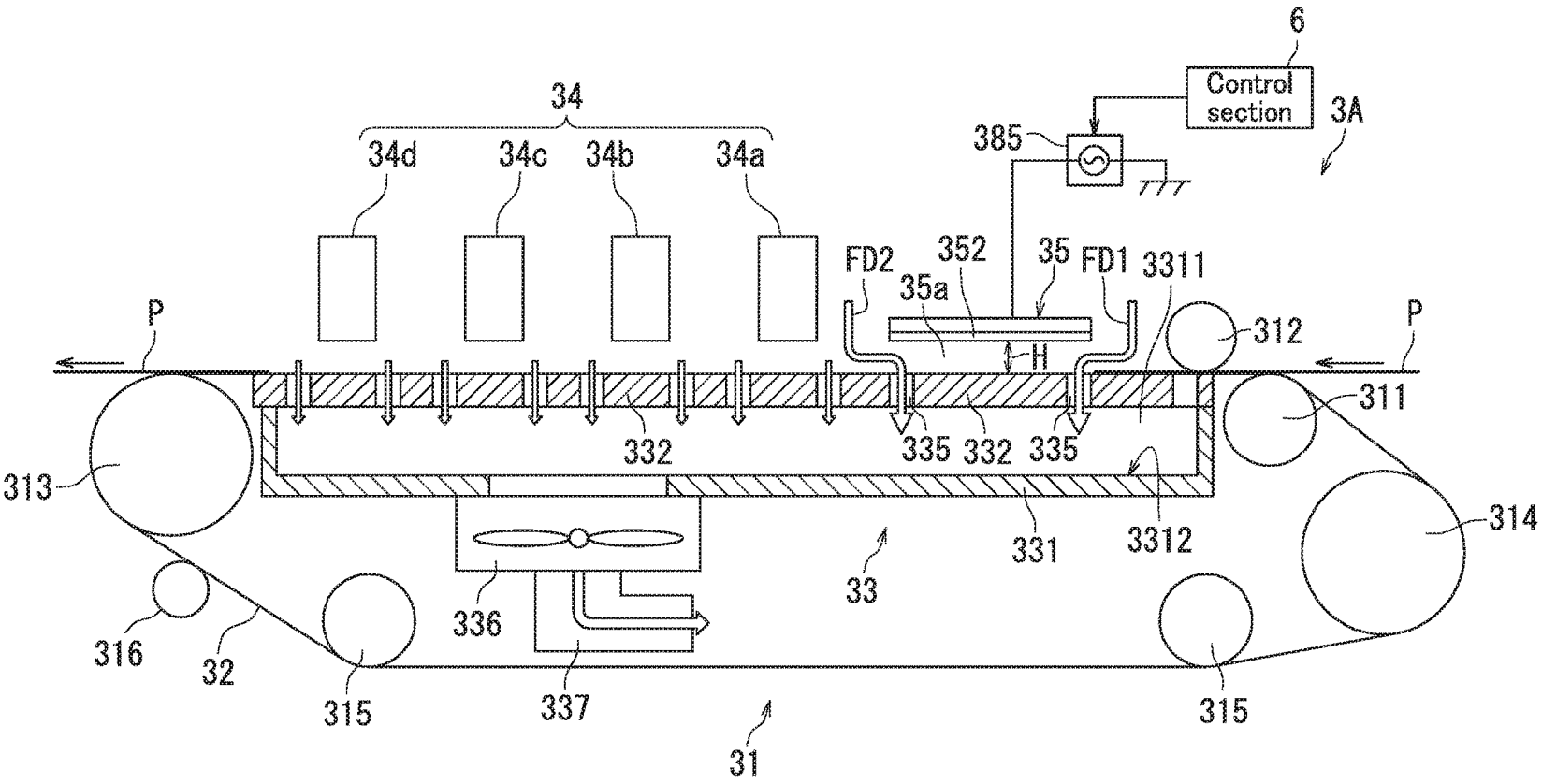
FIG. 15 illustrates a cleaning mechanism of a plate member according to a variation of the second embodiment.

FIG. 15 illustrates a cleaning mechanism of the plate member 35 according to the variation of the second embodiment. As illustrated in FIG. 15, in the variation of the second embodiment, the fifth voltage applying section 385 applies an alternating current voltage to the plate member 35. Through application of the alternating current voltage to the plate member 35, the charge of paper dust PD attached to the plate member 35 can be reduced and attachment strength of the paper dust PD to the plate member 35 can be weakened in the same way as in the second embodiment.

In the second embodiment, only paper dust PD charged to opposite polarity to the polarity of the direct current voltage applied to the plate member 35 detaches from the plate member 35. In contrast, according to the variation of the second embodiment, attachment strength of paper dust PD can be weakened regardless of whether the paper dust PD is charged to positive polarity or negative polarity. Therefore, both paper dust PD charged to positive polarity and paper dust PD charged to negative polarity can be caused to detach from the plate member 35.

Furthermore, according to the variation of the second embodiment, a situation in which the charging polarity of paper dust PD changes due to voltage application by the fifth voltage applying section 385 can be restricted. Therefore, a voltage application time of the fifth voltage applying section 385 can be set freely. For the same reason, a start timing of the suction operation by the negative pressure applying section 33 can be set freely.

The voltage value of an application voltage (alternating current voltage) of the fifth voltage applying section 385 is preset in accordance with a material from which the plate member 35 is made. Furthermore, ambient conditions (temperature and humidity) around the plate member 35 may be taken into account in setting of the voltage value of the application voltage (alternating current voltage) of the fifth voltage applying section 385. Material properties of paper dust PD may also be taken into account in setting of the voltage value of the application voltage (alternating current voltage) of the fifth voltage applying section 385. Furthermore, in a situation in which the cleaning operation of the plate member 35 is performed periodically, the amount of paper dust PD attached to the plate member 35 may be taken into account in setting of the voltage value of the application voltage (alternating current voltage) of the fifth voltage applying section 385. The voltage value of the application voltage (alternating current voltage) of the fifth voltage applying section 385 has, for example, a positive polarity maximum voltage value of +5 kV and a negative polarity maximum voltage value of −5 kV.

Although the variation of the second embodiment is explained for a configuration in which an alternating current voltage is applied to the plate member 35, in an alternative configuration, a composite voltage in which an alternating current voltage is superimposed on a direct current voltage may be applied to the plate member 35. In such a configuration, the voltage value of the direct current voltage is, for example, +5 V. The alternating current component may have a positive polarity maximum value of +5 kV and a negative polarity maximum value of −5 kV.

Through the above, the second embodiment of the present disclosure has been explained with reference to the drawings. However, the present disclosure is not limited by the above second embodiment and can be implemented in various forms without deviating from the essence of the present disclosure.

For example, although the conveyor belt 32 circulates while the suction operation is being performed by the negative pressure applying section 33 in the second embodiment of the present disclosure, the present disclosure is not limited to such a configuration. In a situation in which the negative pressure applying section 33 starts the suction operation before the voltage application operation by the fourth voltage applying section 384, circulation of the conveyor belt 32 may start in a period between the negative pressure applying section 33 starting the suction operation and the fourth voltage applying section 384 starting the voltage application operation.

Although the cleaning operation of the plate member 35 is performed in accordance with the maintenance time of the recording heads 34 in the second embodiment of the present disclosure, the present disclosure is not limited to such a configuration. So long as the cleaning operation of the plate member 35 is performed in a non-recording period, the cleaning operation of the plate member 35 may be performed at a different time to the maintenance time of the recording heads 34.

In the second embodiment of the present disclosure, the negative pressure applying section 33 starts the suction operation at the same time as the fourth voltage applying section 384 starts the voltage application operation or before the fourth voltage applying section 384 starts the voltage application operation. However, the present disclosure is not limited to such a configuration. The negative pressure applying section 33 may start the suction operation after the fourth voltage applying section 384 starts the voltage application operation or after the fourth voltage applying section 384 ends the voltage application operation.

Although the second embodiment of the present disclosure is explained for a configuration in which the sheet P is conveyed by the conveyor belt 32, in an alternative configuration, the sheet P may be conveyed by a different method. For example, in an alternative configuration, the sheet P may be conveyed by conveyance rollers. In such a configuration, air is preferably sucked from between adjacent conveyance rollers.

Although the second embodiment of the present disclosure is explained for a configuration in which the narrow gap 35*a* is formed by the plate member 35, in an alternative configuration, the narrow gap 35*a* may be formed in a different manner. For example, in an alternative configuration, the head base 37 may extend toward the conveyor belt 32 at a position upstream of the recording heads 34 in the conveyance direction of the sheet P and may thereby form the narrow gap 35*a*. The above configuration can simplify structure.

Although the second embodiment of the present disclosure is explained for a configuration in which the hole 371 is provided in the head base 37, the present disclosure is not limited to such a configuration. In an alternative configuration, the length of the head base 37 in the conveyance direction of the sheet P may be shortened such that the size of a gap between an upstream end of the head base 37 in the conveyance direction of the sheet P and the placement roller 312 is increased.

Although the second embodiment of the present disclosure is explained for a configuration in which the plate member 35 is fixed to the head base 37, in an alternative configuration, the plate member 35 may be fixed to a different fixing member provided inside the apparatus housing 100. For example, in an alternative configuration, opposite ends of the plate member 35 in the width direction of the sheet P may be fixed to a fixing member. Through the above configuration, air flow velocity in the narrow gap 35*a* can be further increased because there is no element present that blocks air flow into the narrow gap 35*a* from upstream or downstream of the plate member 35 in the conveyance direction of the sheet P. Therefore, paper dust can be more effectively removed.

Although the second embodiment of the present disclosure is explained for a configuration in which the guide member 332 having the grooves 334 is provided, in an alternative configuration, a guide member without grooves 334 may be provided. In such a configuration, the guide member preferably has a larger number of through holes 335 than the guide member 332 having the grooves 334 in order that a sheet P is reliably held on the conveyor belt 32 by suction.

Although the second embodiment of the present disclosure is explained for a configuration in which the guide member 332 and the air flow chamber 331 are separate elements, in an alternative configuration, the guide member 332 and the air flow chamber 331 may be integrated together. In the above configuration, leakage of negative pressure from the air flow chamber 331—that is, inflow of air to the air flow chamber 331 through a gap between the guide member 332 and the air flow chamber 331—can be prevented.

Although the second embodiment of the present disclosure is explained for a situation in which the present disclosure is applied to an inkjet recording apparatus that can record a full-color image, the present disclosure can also be applied to an inkjet recording apparatus that records a monochrome image.

It should be noted that matter explained in the second embodiment of the present disclosure may be combined as appropriate.

What is claimed is:

1. An inkjet recording apparatus comprising:

a control section;

a conveyance section configured to convey a recording medium placed on a conveying surface;

a recording head configured to eject ink onto the recording medium conveyed by the conveyance section to form an image on the recording medium;

a negative pressure applying section configured to apply negative pressure via a plurality of holes in the conveying surface to suck the recording medium conveyed by the conveyance section onto the conveying surface;

a gap forming section configured to form a narrow gap in conjunction with the conveying surface at a location further upstream in a conveyance direction of the recording medium than the recording head and including a conductive portion that is electrically conductive and that composes at least a part of the gap forming section; and a first voltage applying section configured to apply a voltage to the conductive portion, wherein a distance across the narrow gap in a direction perpendicular to the conveying surface is set such that air flowing into the narrow gap from surrounding space has a higher flow velocity in the narrow gap than before flowing into the narrow gap, and the control section controls the first voltage applying section to apply the voltage to the conductive portion while the inkjet recording apparatus performs a specific process.

2. The inkjet recording apparatus according to claim 1, wherein the gap forming section includes a plurality of conductive portions, the conductive portions are arranged at specific intervals in the conveyance direction, and the first voltage applying section applies a voltage to each of the conductive portions such that voltages of different polarities are applied to adjacent conductive portions among the plurality of conductive portions.

3. The inkjet recording apparatus according to claim 1, wherein the gap forming section is provided as a plurality of gap forming sections, the gap forming sections are arranged at specific intervals in the conveyance direction, and the first voltage applying section applies a voltage to the conductive portion of each of the gap forming sections such that voltages of different polarities are applied to conductive portions of adjacent gap forming sections among the plurality of gap forming sections.

4. The inkjet recording apparatus according to claim 1, wherein the gap forming section forms the narrow gap such that the distance across the narrow gap in the direction perpendicular to the conveying surface is no greater than a preset threshold distance.

5. The inkjet recording apparatus according to claim 1, wherein the conveyance section includes a conveyor belt and an upper surface of the conveyor belt is the conveying surface on which the recording medium is conveyed, the specific process is a process that is accompanied by driving of the conveyor belt, and upon receiving an instruction to start the specific process, the inkjet recording apparatus performs the specific process after performing (1) to (3), shown below, in order:

(1) starting application of the negative pressure by the negative pressure applying section;

(2) starting application of the voltage to the conductive portion by the first voltage applying section; and (3) starting driving of the conveyor belt.

6. The inkjet recording apparatus according to claim 5, wherein once the specific process ends, the inkjet recording apparatus performs (4) to (6), shown below, in order:

(4) stopping driving of the conveyor belt;

(5) stopping application of the voltage to the conductive portion by the first voltage applying section; and (6) stopping application of the negative pressure by the negative pressure applying section.

7. The inkjet recording apparatus according to claim 5, wherein the specific process is either or both of an image formation process of forming the image on the recording medium and a cleaning process of internally cleaning the inkjet recording apparatus.

8. The inkjet recording apparatus according to claim 1, wherein at least part of the recording head is charged to a first polarity in ejection of the ink, and the first voltage applying section applies a voltage of the first polarity to the conductive portion.

9. The inkjet recording apparatus according to claim 8, further comprising:

a placement roller configured to press the recording medium against the conveying surface at a location further upstream in the conveyance direction than the gap forming section and feed the recording medium downstream in the conveyance direction; and a second voltage applying section configured to apply a voltage of a second polarity, opposite to the first polarity, to the placement roller, wherein the control section controls the second voltage applying section to apply the voltage of the second polarity to the placement roller while the voltage of the first polarity is applied to the conductive portion.

10. The inkjet recording apparatus according to claim 8, further comprising:

a charge imparting section configured to impart charge to the recording medium and paper dust attached to the recording medium at a location further upstream in the conveyance direction than the recording head and further downstream in the conveyance direction than the gap forming section, the charge imparting section imparting charge of the same polarity as a voltage that is applied thereto; and a third voltage applying section configured to apply a voltage of the first polarity to the charge imparting section, wherein the control section controls the third voltage applying section to apply the voltage of the first polarity to the charge imparting section while the voltage of the first polarity is applied to the conductive portion.

11. The inkjet recording apparatus according to claim 1, wherein the gap forming section is a plate member that is located opposite to the conveying surface of the conveyance section on which the recording medium is placed and that has a flat surface that is substantially parallel to the conveying surface.

12. The inkjet recording apparatus according to claim 11, further comprising a head base configured to support the recording head, wherein the plate member is fixed to the head base, and the head base has a hole located further upstream in the conveyance direction than the plate member and a hole located further downstream in the conveyance direction than the plate member that allow air to flow into the narrow gap.

13. The inkjet recording apparatus according to claim 11, wherein the plate member has a tapered shape such that the distance across the narrow gap in the direction perpendicular to the conveying surface becomes larger with increasing proximity to an end of the plate member in the conveyance direction of the recording medium.

14. The inkjet recording apparatus according to claim 1, wherein the negative pressure applying section performs a suction operation in accordance with an application operation of the voltage by the first voltage applying section.

15. The inkjet recording apparatus according to claim 14, wherein the conveyance section includes a conveyor belt that conveys the recording medium and a guide member that supports the recording medium through the conveyor belt, the negative pressure applying section sucks air through the conveyor belt and the guide member, and the conveyor belt circulates in accordance with the application operation of the voltage by the first voltage applying section.

16. The inkjet recording apparatus according to claim 14, wherein the voltage applied to the conductive portion by the first voltage applying section is a direct current voltage.

17. The inkjet recording apparatus according to claim 14, wherein the voltage applied to the conductive portion by the first voltage applying section is an alternating current voltage.

18. The inkjet recording apparatus according to claim 14, wherein the voltage applied to the conductive portion by the first voltage applying section is a composite voltage of an alternating current voltage superimposed on a direct current voltage.

19. The inkjet recording apparatus according to claim 14, wherein the first voltage applying section applies the voltage to the conductive portion in accordance with a maintenance time of the recording head.

* * * * *